US010188929B2

(12) United States Patent
Kabes

(10) Patent No.: US 10,188,929 B2
(45) Date of Patent: Jan. 29, 2019

(54) ADAPTED FITNESS EQUIPMENT

(71) Applicant: Joseph Warren Kabes, Rochester, NY (US)

(72) Inventor: Joseph Warren Kabes, Rochester, NY (US)

( * ) Notice: Subject to any disclaimer, the term of this patent is extended or adjusted under 35 U.S.C. 154(b) by 0 days.

(21) Appl. No.: 15/072,417

(22) Filed: Mar. 17, 2016

(65) Prior Publication Data

US 2016/0271478 A1 Sep. 22, 2016

Related U.S. Application Data

(60) Provisional application No. 62/135,764, filed on Mar. 20, 2015, provisional application No. 62/149,542, filed on Apr. 18, 2015.

(51) Int. Cl.
*A63B 69/34* (2006.01)
*A63B 71/00* (2006.01)
(Continued)

(52) U.S. Cl.
CPC ..... *A63B 71/0009* (2013.01); *A63B 17/04* (2013.01); *A63B 21/0552* (2013.01); *A61H 3/04* (2013.01); *A61H 2201/1261* (2013.01); *A63B 5/20* (2013.01); *A63B 21/00061* (2013.01); *A63B 21/00069* (2013.01); *A63B 21/026* (2013.01); *A63B 21/06* (2013.01); *A63B 21/068* (2013.01); *A63B 21/151* (2013.01); *A63B 21/1609* (2015.10); *A63B 21/4019* (2015.10); *A63B 21/4035* (2015.10);
(Continued)

(58) Field of Classification Search
CPC ... A63B 71/0009; A63B 17/04; A63B 21/026; A63B 21/4019; A63B 69/18; A63B 21/06; A63B 21/068; A63B 21/151; A63B 22/20; A63B 23/03516; A63B 23/0355; A63B 23/0405; A63B 23/047; A63B 23/1209; A63B 21/00069; A63B 21/4043; A63B 2071/025; A63B 59/50; A63B 63/08; A63B 69/0088; A63B 71/023; A63B 71/141; A63B 59/42; A63B 59/00; A63B 59/20; A63B 2209/10; A63B 2210/50; A63B 2225/09; A63B 59/70; A63B 2071/0018; A63B 21/4035; A63B 5/20; G09B 19/00
USPC ..... 482/51, 66–69, 74, 83–90, 121–130
See application file for complete search history.

(56) References Cited

U.S. PATENT DOCUMENTS 3,986,502 A * 10/1976 Gilson ..... A61H 3/00 135/68
4,368,898 A * 1/1983 Lay ..... A63B 71/0009 280/304.1
4,453,742 A * 6/1984 Zepkowski ..... A63B 69/18 280/22.1
4,470,598 A * 9/1984 Steele ..... A63B 71/0009 280/304.1
(Continued)

*Primary Examiner* — Garrett Atkinson
(74) *Attorney, Agent, or Firm* — Michael J. Nickerson; Basch & Nickerson LLP

(57) ABSTRACT

An exercise apparatus includes an adjustable frame being attachable to an assistive ambulation device. The adjustable frame includes removable handles, fitting arms located on a lower portion of the adjustable frame to receive a fitness attachment, and attachment points on located on the lower portion of the adjustable frame to couple a resistance device. A jump rope trainer includes a handle; flexible tubing including a handle fastener to connect the handle to the flexible tubing; and a soft sphere shaped object. The flexible tubing includes a soft sphere shaped object fastener to connect the soft sphere shaped object to the flexible tubing.

15 Claims, 24 Drawing Sheets

(51) Int. Cl.

| | |
|---|---|
| ***A63B 17/04*** | (2006.01) |
| ***A63B 21/055*** | (2006.01) |
| *A63B 5/20* | (2006.01) |
| *A63B 21/02* | (2006.01) |
| *A63B 21/00* | (2006.01) |
| *A63B 63/08* | (2006.01) |
| *A63B 69/00* | (2006.01) |
| *A63B 71/02* | (2006.01) |
| *A63B 71/14* | (2006.01) |
| *A63B 59/00* | (2015.01) |
| *A63B 59/70* | (2015.01) |
| *A63B 59/20* | (2015.01) |
| *A63B 59/42* | (2015.01) |
| *A63B 59/50* | (2015.01) |
| *A63B 69/18* | (2006.01) |
| *A63B 21/06* | (2006.01) |
| *A63B 21/068* | (2006.01) |
| *A63B 22/20* | (2006.01) |
| *A63B 23/04* | (2006.01) |
| *A63B 23/12* | (2006.01) |
| *A63B 71/06* | (2006.01) |
| *A63B 21/16* | (2006.01) |
| *A61H 3/04* | (2006.01) |
| *A63B 23/035* | (2006.01) |

(52) U.S. Cl.

CPC ..... *A63B 21/4043* (2015.10); *A63B 22/20* (2013.01); *A63B 23/03541* (2013.01); *A63B 23/0405* (2013.01); *A63B 23/047* (2013.01); *A63B 23/1209* (2013.01); *A63B 59/00* (2013.01); *A63B 59/20* (2015.10); *A63B 59/42* (2015.10); *A63B 59/50* (2015.10); *A63B 59/70* (2015.10); *A63B 63/08* (2013.01); *A63B 69/0088* (2013.01); *A63B 69/18* (2013.01); *A63B 71/023* (2013.01); *A63B 71/141* (2013.01); *A63B 2071/0018* (2013.01); *A63B 2071/025* (2013.01); *A63B 2071/0625* (2013.01); *A63B 2209/10* (2013.01); *A63B 2210/50* (2013.01); *A63B 2225/09* (2013.01)

(56) References Cited

U.S. PATENT DOCUMENTS 4,753,449 A * 6/1988 Doucet ..... A63B 47/00 280/304.1
4,824,132 A * 4/1989 Moore ..... A61G 5/023 280/250.1
4,826,151 A * 5/1989 Nuredin ..... A63B 21/0004 297/423.38
4,867,445 A * 9/1989 Connelly ..... A63B 21/0004 482/113
5,116,067 A * 5/1992 Johnson ..... A61G 5/10 280/14.1
5,284,131 A * 2/1994 Gray ..... A61H 1/0214 482/57
5,330,402 A * 7/1994 Johnson ..... A63B 22/0012 482/52
5,397,154 A * 3/1995 Baldwin ..... A63C 3/00 188/8
5,478,299 A * 12/1995 Harmon ..... A63B 21/0552 482/121
5,520,597 A * 5/1996 Tobin ..... A61H 3/00 135/67
5,584,783 A * 12/1996 Hagg ..... A63B 22/0605 482/123
5,645,516 A * 7/1997 Foster ..... A63B 21/0004 482/121
5,713,821 A * 2/1998 Nissen ..... A63B 23/04 482/114
5,807,185 A * 9/1998 Raubuck ..... A63B 65/12 124/1
5,807,211 A * 9/1998 Berryhill ..... A63B 21/0552 482/129
5,895,341 A 4/1999 Jones
5,913,749 A * 6/1999 Harmon ..... A63B 1/00 482/129
6,004,233 A * 12/1999 Raubuck ..... A63B 65/12 124/20.1
6,042,482 A * 3/2000 Wilds ..... A63D 5/00 273/120 R
6,416,447 B1 * 7/2002 Harmon ..... A63B 21/0023 482/121
6,453,921 B1 * 9/2002 Rost ..... A61H 3/00 135/67
6,474,671 B1 * 11/2002 San Miguel Gomez ..... A61G 5/10 280/304.1
6,612,971 B1 * 9/2003 Morris ..... A63B 23/047 473/441
6,645,127 B1 * 11/2003 Pestes ..... A63B 21/225 482/51
6,692,417 B2 * 2/2004 Burrell ..... A63B 21/00047 482/141
6,887,188 B1 5/2005 Davies
7,001,313 B1 * 2/2006 Crnkovich ..... A61H 3/04 135/67
7,104,565 B1 * 9/2006 Albert ..... B62B 1/206 280/47.18
7,370,734 B2 * 5/2008 Hallgrimsson ..... A61G 5/08 188/19
7,377,285 B2 * 5/2008 Karasin ..... A61H 3/04 135/66
7,510,214 B1 * 3/2009 Oxford ..... A63B 22/14 280/827
7,874,962 B1 * 1/2011 Pestes ..... A63B 22/0002 482/51
8,061,376 B2 * 11/2011 Ryan ..... A61H 3/04 135/67
8,075,455 B2 12/2011 Gamboa et al.
8,088,047 B2 1/2012 Marji
8,142,333 B2 3/2012 LaTour
8,162,809 B1 * 4/2012 Eastwood ..... A63B 21/0442 482/123
8,434,824 B2 * 5/2013 Spinabella ..... A47B 97/00 108/50.14
8,936,538 B2 * 1/2015 Marcantonio ..... A47K 17/02 482/112
8,961,186 B2 * 2/2015 LoSasso ..... A63B 71/0622 434/255
9,149,408 B2 * 10/2015 Karlovich ..... A63B 69/0064
9,162,101 B2 * 10/2015 Zondervan ..... A63B 21/04
9,393,173 B1 * 7/2016 Meza ..... A63B 21/055
2002/0086780 A1 * 7/2002 Morris ..... A63B 69/345 482/136
2002/0169058 A1 * 11/2002 Harmon ..... A63B 21/0023 482/142
2003/0203792 A1 * 10/2003 Pestes ..... A63B 21/225 482/60
2008/0161162 A1 * 7/2008 Dokshutsky ..... A63B 21/0552 482/9
2011/0143893 A1 * 6/2011 Marcantonio ..... A47K 17/02 482/112
2014/0371038 A1 * 12/2014 Markowitz ..... A63B 21/4035 482/123
2015/0057137 A1 * 2/2015 Chen ..... A63B 23/03583 482/135
2015/0335940 A1 * 11/2015 Johnson ..... A63B 21/1488 248/118

* cited by examiner

ADAPTED FITNESS EQUIPMENT

PRIORITY INFORMATION

This application claims priority from U.S. Provisional Patent Application, Ser. No. 62/135,764, filed on Mar. 20, 2015. The entire content of U.S. Provisional Patent Application, Ser. No. 62/135,764, filed on Mar. 20, 2015, is hereby incorporated by reference.

This application claims priority from U.S. Provisional Patent Application, Ser. No. 62/149,542, filed on Apr. 18, 2015. The entire content of U.S. Provisional Patent Application, Ser. No. 62/149,542, filed on Apr. 18, 2015, is hereby incorporated by reference.

BACKGROUND

Exercise can help with weight control, can help improve an individual's health conditions, can help fight disease, can help improve an individual's mood, and/or can help boost an individual's energy level. The benefits of consistent strength training and aerobic exercise have been well documented by the medical field.

In order to assist people in achieving muscular strength, muscular endurance, and cardiovascular endurance, developers of conventional exercise equipment have come out with numerous devices including electronic, cam/pulley, and weight stack resistance machines, as well as cardiovascular machines; such as, rowers, stationary bicycles, treadmills, stair climbers, etc.

However, a large number of conventional exercise equipment is not configured for use by individuals with physical disabilities or special needs, such as individuals requiring a wheelchair, walker, stander, and/or other assistive ambulation device.

This shortfall in the amount of exercise equipment available to individuals with physical disabilities or special needs has made it difficult for individuals with physical disabilities or special needs to benefit from exercise.

Moreover, this shortfall in the amount of exercise equipment available to individuals with physical disabilities or special needs has, in some instances created a sense of exclusion for the individuals as they cannot participate in many activities, thereby negatively impacting their sense of self-worth.

On the other hand, if an individual with physical disabilities or special needs uses non-configured conventional exercise equipment, the individual may find the equipment difficult to use and/or unsafe to use.

Another form of exercise is jump rope. However, jump rope is not necessarily an easy skill to master for individuals with no physical disabilities or special needs, let alone for an individual with a physical disability or special need.

More specifically, individuals with physical disabilities or special needs; such as grasping issues and/or limited to no ability to walk; are unable to actually jump a traditional jump rope. Thus, these individuals miss out on the aerobic and anaerobic benefits of this form of exercise.

With traditional jump ropes, there is usually one length of rope attached to handles at each end. The user grips the handles and swings the rope over and jumps over the rope as it passed under the user's feet. The object is to continue this pattern in a rhythmic fashion for a specific number of times (jumps) or a given amount of time.

Often, users misjudge the timing of the jumps and lose rhythm and timing and/or trip over the rope, resulting in injury.

To realize the aerobic and anaerobic benefits of jumping rope without the danger and risk of injuring oneself, a conventional jump rope simulator/trainer can be used to mimic a jump rope without a rope actually passing under a user's feet.

The conventional jump rope simulator/trainer is grasped in the hands of the exerciser and rotated. The user may or may not jump periodically and rhythmically depending on their ability.

Since the swinging of the conventional jump rope simulator/trainer mimics the action of swinging a traditional rope, and the user has the choice of jumping or not, they can still attain health and skill related benefits.

Conventional jump rope simulator/trainers utilize a conventional jump rope handle resulting in issues for individuals with physical disabilities or special needs associated with grasping.

Moreover, conventional jump rope simulator/trainers utilize a variety of weighted objects to provide centrifugal force and a cord to produce centripetal force. The weighted objects could be a source of injury if the individual using the conventional jump rope simulator/trainer lacks the motor skills to rotate the weighted object correctly.

Thus, it is desirable to provide adapted fitness equipment that can be used by both ambulatory and non-ambulatory individuals to increase their health and sport-related fitness levels.

It is further desirable to provide adapted fitness equipment that works with multiple forms of assistive ambulation equipment like walkers, wheelchairs, gait trainers, standers, etc.

Moreover, it is desirable to provide adapted fitness equipment that can be used by individuals having different sizes, different levels of physical fitness, and/or different levels of physical disability.

Furthermore, it is desirable to provide a jump rope simulator/trainer that utilizes a grasping mechanism (handle) that enables an individual with physical disabilities or special needs associated with grasping to effectively use the jump rope simulator/trainer.

In addition, it is desirable to provide a jump rope simulator/trainer that utilizes a rotating member, which provides centrifugal force, which is shaped to reduce injury to individuals who lack the motor skills to rotate the rotating member correctly.

BRIEF DESCRIPTION OF THE DRAWINGS

The drawings are only for purposes of illustrating various embodiments and are not to be construed as limiting, wherein.

DETAILED DESCRIPTION

Figure 1:
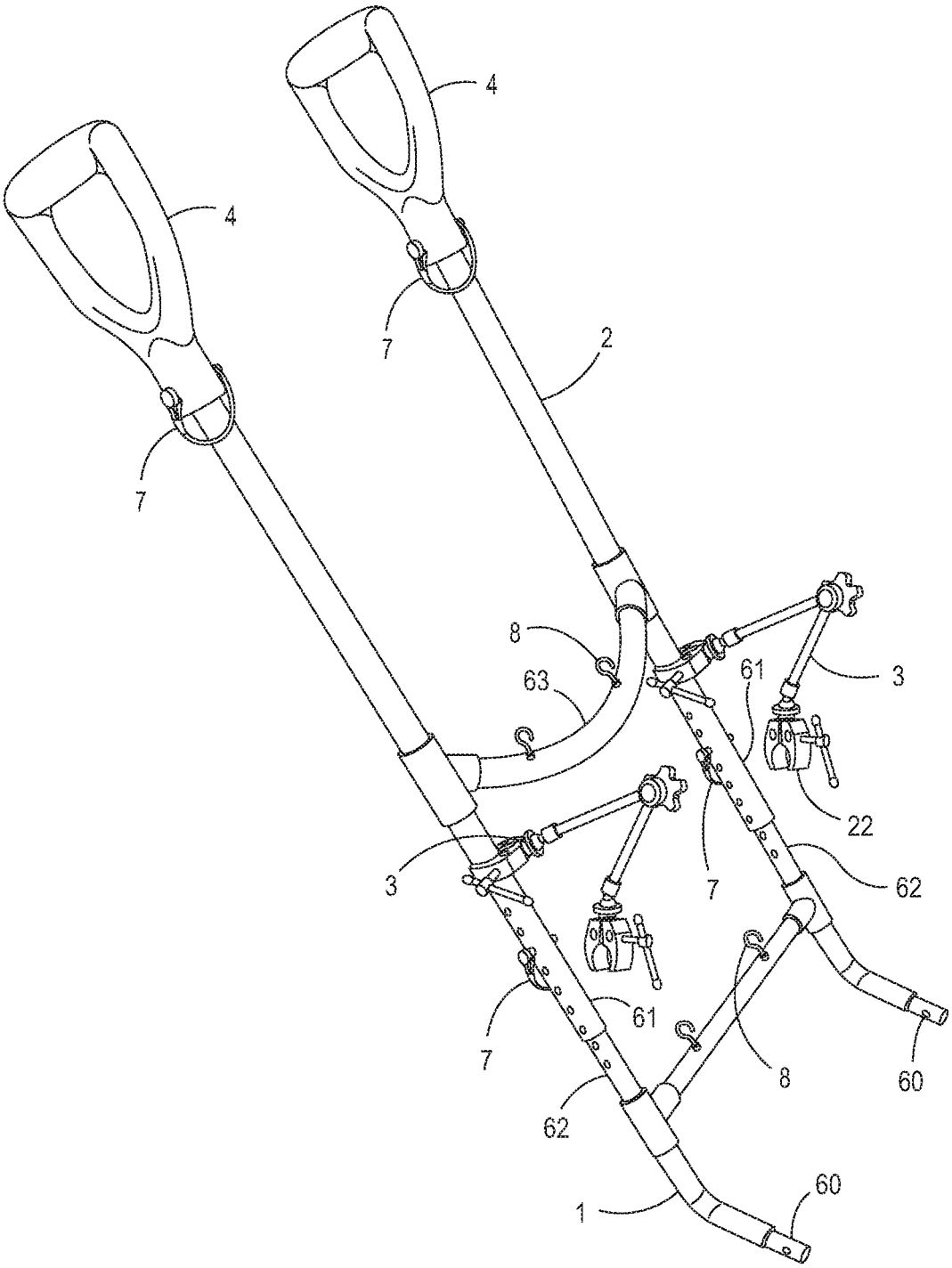
FIG. 1 illustrates a schematic view of an upper and lower frame of an exercise apparatus including a clamping mechanism.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts could be properly illustrated.

As illustrated in FIG. 1, an exercise apparatus includes a lower frame and an upper frame. The lower frame and upper frame may be composed of rigid interconnecting tubes (1 and 2).

Although FIG. 1 illustrates the lower frame and the upper frame being constructed of rigid interconnecting tubes, the frame may be constructed of any rigid lightweight material. Moreover, the frames need not be formed of tubes but may have any geometric shape that allows interconnectability.

Figure 3:
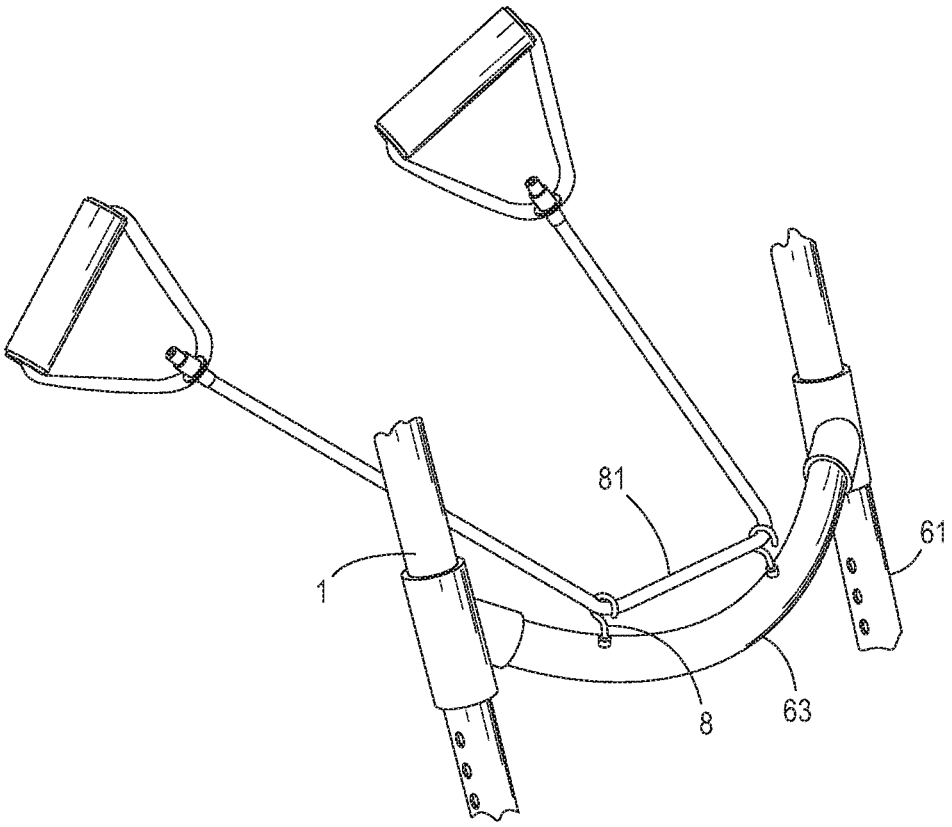
FIG. 3 illustrates a fragmentary view of the lower embodiment of the exercise apparatus of FIG. 1, showing attachments for various fitness tubing and resistance training devices.

The lower frame includes fitting arms 60, which are configured to receive various fitness and/or sport related skill attachments. The lower frame and upper frame include fastener elements 8 for attaching a variety of resistance tubing (as illustrated in FIG. 3) and weight resistance devices (not shown).

Although FIG. 1 illustrates the fitting arms 60 as being projections from the lower frame that are received by an attachment, the attachment may have projecting fitting arms and the lower frame has a receiving portion for engaging the fitting arms. Moreover, the mechanism for connecting the lower frame to the attachment may be any conventional connecting mechanism that facilitates connect and disconnect characteristics.

For example, the mechanism for connecting the lower frame to the attachment may be a pin 7, as illustrated in FIG. 1. Moreover, the mechanism for connecting the lower frame to the attachment may be a shear pin to protect the lower frame and/or the attachment (not shown).

The upper frame includes interchangeable detachable handles 4, which may be attached by a pin 7. The lower frame includes an incremental lower frame adjustment section 62 that includes points/holes. The upper frame also includes an incremental upper frame adjustment section 61 that includes points/holes.

As illustrated in FIG. 1, the lower frame is connected to the upper frame by lining up holes in the incremental lower frame adjustment section 62 and incremental upper frame adjustment section 61 and inserting a pin 7 through the lined up holes. This allows the overall frame to be adjusted to accommodate individuals and equipment of various sizes.

Although FIG. 1 illustrates the exercise apparatus as being constructed of two detachable frames, the exercise apparatus may be an integral frame that is capable of expanding and contracting in length to facilitate connection to various assistive ambulation devices and to accommodate individuals and equipment of various sizes.

The lined up holes hold the lower frame and upper frame together by attaching pins 7. The fitting arms 60 hold the lower frame to a fitness and/or sport related skill attachment (not shown) by using pins 7. The attachment points (not shown) on interchangeable detachable handles 4 hold interchangeable detachable handles 4 to the upper frame by pins 7.

It is noted that although the attaching pins 7 have been illustrated as removable locking pins, it is noted that the incremental lower frame adjustment section 62 of the lower frame or the incremental upper frame adjustment section 61 of the upper frame may have built-in push pins that enables the securing of the lower frame and upper frame together.

It is further noted that the connecting mechanism for connecting the lower and upper frames may be any conventional connection mechanism that enables expanding and contracting in length to facilitate connection to various assistive ambulation devices and to accommodate individuals and equipment of various sizes.

FIG. 1 also illustrates an articulation system, which includes clamp 22 and articulation arm 3, which enables the exercise apparatus to be securely mounted to a wheelchair, walker, gait trainer, stander, and/or other assistive ambulation equipment.

Lastly, FIG. 1 illustrates horizontal support 63 connected between vertical sections of the lower frame and upper frame. The fastener elements 8 are located on the horizontal support 63.

Although FIG. 1 illustrates two horizontal supports, the exercise apparatus may include more than two horizontal supports connected between vertical sections of the lower frame and upper frame.

It is noted that non-abrasive feet/skis, wheels, rollers, and/or bearings may be statically attached to the lower frame near the fitting arms 60.

It is further noted that non-abrasive feet/skis, wheels, rollers, and/or bearings may be dynamically attached to the lower frame near the fitting arms 60 so to allow the non-abrasive feet/skis, wheels, rollers, and/or bearings to float with the terrain and/or floor.

Figure 2:
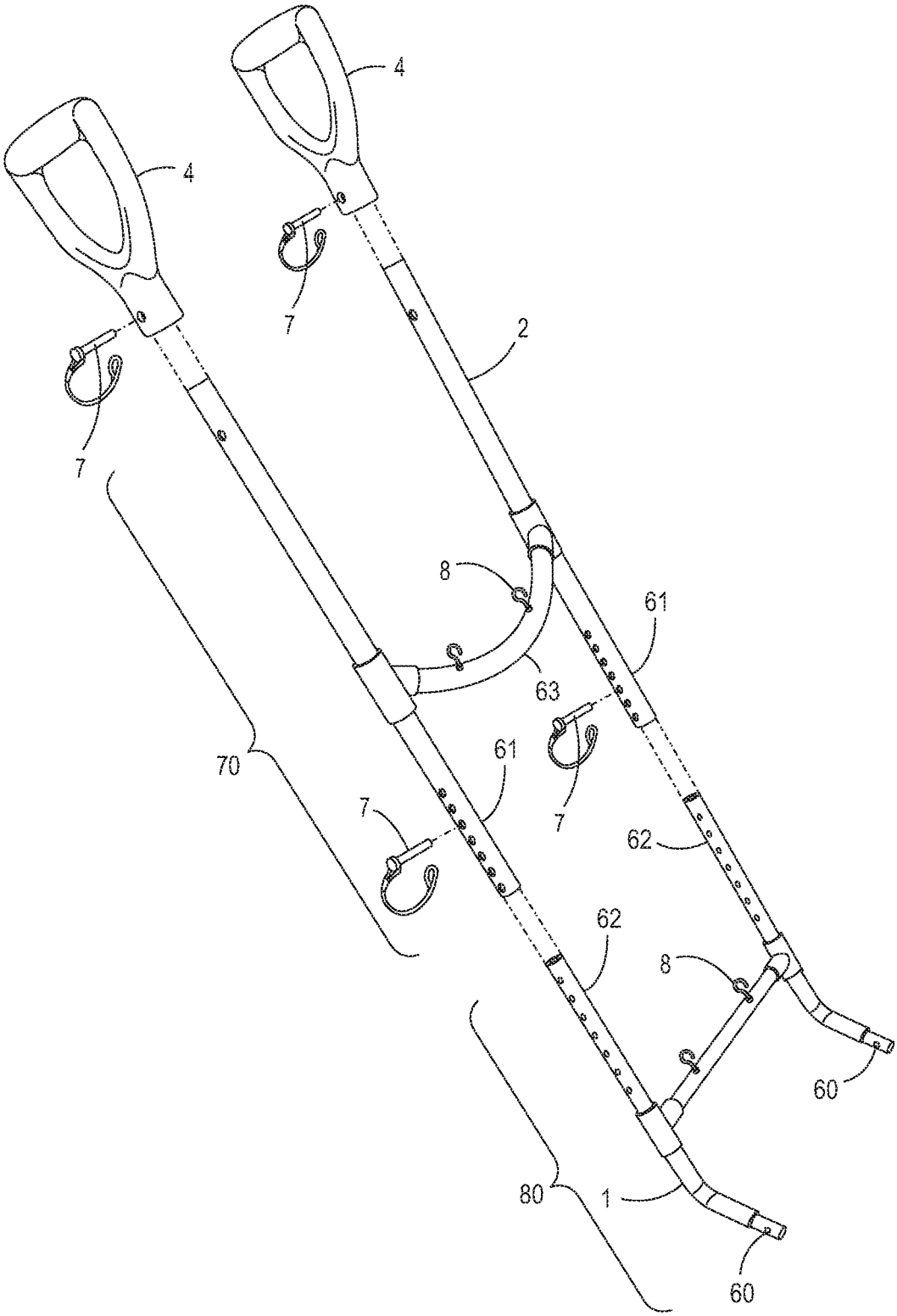
FIG. 2 illustrates a fragmentary view of the exercise apparatus of FIG. 1, showing in detail the adjustability of the upper and lower frame.

FIG. 2 shows a fragmentary view of the exercise apparatus shown in FIG. 1. As illustrated in FIG. 1, FIG. 2 shows an exercise apparatus, which includes a lower frame 80 and an upper frame 70. The lower frame 80 and upper frame 70 may be composed of rigid interconnecting tubes (1 and 2).

Although FIG. 2 illustrates the lower frame 80 and the upper frame 70 being constructed of rigid interconnecting tubes, the frame may be constructed of any rigid lightweight material. Moreover, the frames need not be formed of tubes but may have any geometric shape that allows interconnectability.

The lower frame 80 includes fitting arms 60, which are configured to receive various fitness and/or sport related skill attachments. The lower frame 80 and upper frame 70 include fastener elements 8 for attaching a variety of resistance tubing (as illustrated in FIG. 3) and weight resistance devices (not shown).

Although FIG. 2 illustrates the fitting arms 60 as being projections from the lower frame 80 that are received by an attachment, the attachment may have projecting fitting arms and the lower frame 80 may have a receiving portion for engaging the fitting arms. Moreover, the mechanism for connecting the lower frame 80 to the attachment may be any conventional connecting mechanism that facilitates connect and disconnect characteristics.

For example, the mechanism for connecting the lower frame to the attachment may be a pin 7, as illustrated in FIG. 2. Moreover, the mechanism for connecting the lower frame to the attachment may be a shear pin to protect the lower frame and/or the attachment (not shown).

FIG. 2 shows interchangeable detachable handles 4. The lower frame 80 includes an incremental lower frame adjustment section 62 that includes points/holes. The upper frame 70 also includes an incremental upper frame adjustment section 61 that includes points/holes.

As illustrated in FIG. 2, the lower frame 80 is connected to the upper frame 70 by lining up holes in the incremental lower frame adjustment section 62 and incremental upper frame adjustment section 61 and inserting a pin 7 through the lined up holes. This allows the overall frame to be adjusted to accommodate individuals and equipment of various sizes.

Although FIG. 2 illustrates the exercise apparatus as being constructed of two detachable frames, the exercise apparatus may be an integral frame that is capable of expanding and contracting in length to facilitate connection to various assistive ambulation devices and to accommodate individuals and equipment of various sizes.

The frame adjustment points/holes enables the holding of the lower frame 80 and upper frame 70 together by attaching pins 7. The fitting arms 60 enables the holding of the lower frame 80 to a fitness and/or sport related skill attachment (not shown) by attaching pins 7. The attachment points (not shown) on interchangeable detachable handles 4 enables the holding of interchangeable detachable handles 4 to the upper frame 70 by attaching pins 7.

Lastly, FIG. 2 illustrates horizontal support 63 connected between vertical sections of the lower frame and upper frame. The fastener elements 8 are located on the horizontal support 63.

It is noted that non-abrasive feet/skis, wheels, rollers, and/or bearings may be statically attached to the lower frame near the fitting arms 60.

It is further noted that non-abrasive feet/skis, wheels, rollers, and/or bearings may be dynamically attached to the lower frame near the fitting arms 60 so to allow the non-abrasive feet/skis, wheels, rollers, and/or bearings to float with the terrain and/or floor.

In FIG. 3, this fragmentary view provides an example of how a resistance tube 81 attaches to the fastener elements 8, which are affixed to the horizontal support 63 of the upper lower frame 70 in FIG. 3.

As illustrated in FIG. 3, the resistance tube 81 attaches to the fastener elements 8 to enable a user to engage in resistance training.

Figure 4:
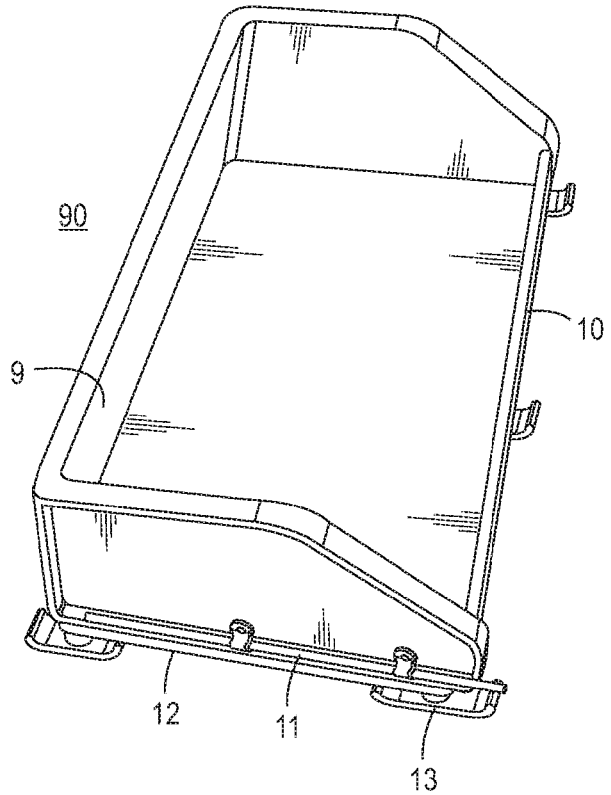
FIG. 4 illustrates a schematic side elevation view of the bucket/sled exercise apparatus attachment.

As illustrated FIG. 4, a bucket/sled exercise apparatus attachment 90 for the exercise apparatus of FIG. 1 may be composed of a molded plastic bucket/sled portion 9, wherein objects or weight resistance can be added to or taken away from depending upon an individual's ability, activity, and/or task.

A molded door 10 may be included, which can be opened or closed and is located in the front of the molded plastic bucket/sled portion 9.

Adjustable and retractable guides 11 are mounted to the side of the molded plastic bucket/sled portion 9, which can be pulled out to extend in front of the molded plastic bucket/sled portion 9 and be utilized to aid in manipulating objects.

The bucket/sled exercise apparatus attachment 90 may include a lightweight sub-frame 12 upon which the molded plastic bucket/sled portion 9 is mounted.

The bucket/sled exercise apparatus attachment 90 may have non-abrasive feet/skis 13, which are mounted to the sub-frame 12, to facilitate contact with the ground or floor.

It is noted that the bucket/sled exercise apparatus attachment 90 may have wheels, rollers, and/or bearings which are mounted to the sub-frame 12, to facilitate contact with the ground or floor.

It is further noted that the non-abrasive feet/skis 13, wheels, rollers, and/or bearings may be statically attached to the sub-frame 12.

It is also noted that the non-abrasive feet/skis 13, wheels, rollers, and/or bearings may be dynamically attached to the sub-frame 12 so to allow the non-abrasive feet/skis 13, wheels, rollers, and/or bearings to float with the terrain and/or floor.

Figure 5:
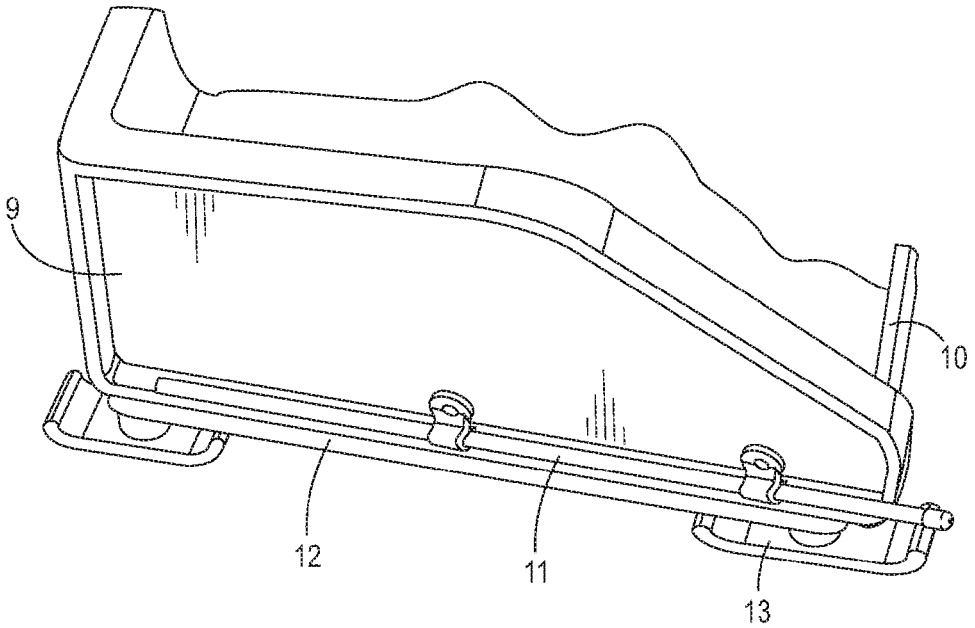
FIG. 5 illustrates a fragmentary side elevation view of a bucket/sled exercise apparatus attachment, showing gliding skis and retractable guides.

FIG. 5 shows a fragmentary side view of the bucket/sled exercise apparatus attachment shown in FIG. 4. As illustrated in FIG. 4, FIG. 5 shows a bucket/sled exercise apparatus attachment for the exercise apparatus of FIG. 1 composed of a molded plastic bucket/sled portion 9.

Although the molded plastic bucket/sled portion 9 has been illustrated as an open bucket, the molded plastic bucket/sled portion 9 may be shaped in various ways; i.e., a mouth, a dinosaur mouth, a hippo mouth, a scope, or other shape that has an opening that enables transporting an object.

Molded door 10 can be opened or closed and is located in the front of the molded plastic bucket/sled portion 9.

Adjustable and retractable guides 11 are mounted to the side of the molded plastic bucket/sled portion 9, which can be pulled out to extend in front of the molded plastic bucket/sled portion 9.

The bucket/sled exercise apparatus attachment may include a lightweight sub-frame 12 upon which the molded plastic bucket/sled portion 9 is mounted.

The bucket/sled exercise apparatus attachment has non-abrasive feet/skis 13, which are mounted to the sub-frame 12, to facilitate contact with the ground or floor.

It is noted that the bucket/sled exercise apparatus attachment may have wheels, rollers, and/or bearings which are mounted to the sub-frame 12, to facilitate contact with the ground or floor.

It is further noted that the non-abrasive feet/skis 13, wheels, rollers, and/or bearings may be statically attached to the sub-frame 12.

It is also noted that the non-abrasive feet/skis 13, wheels, rollers, and/or bearings may be dynamically attached to the sub-frame 12 so to allow the non-abrasive feet/skis 13, wheels, rollers, and/or bearings to float with the terrain and/or floor.

Figure 6:
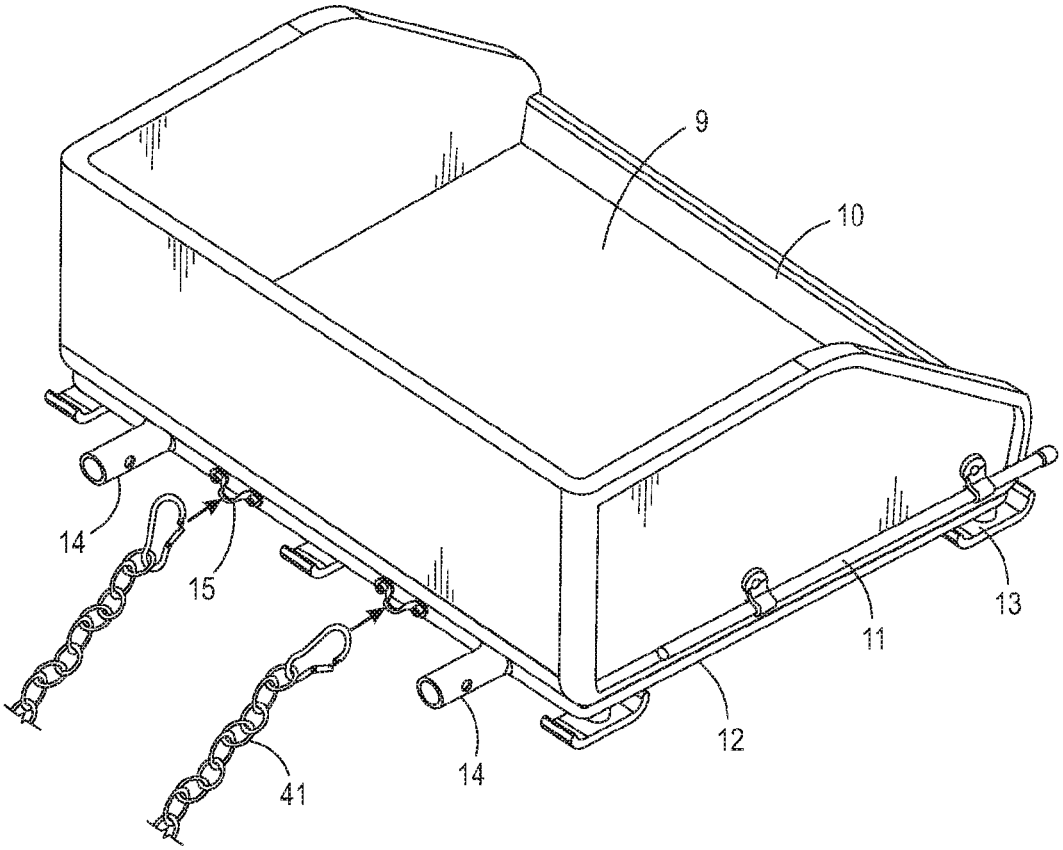
FIG. 6 illustrates a schematic top elevation view of a bucket/sled exercise apparatus attachment, showing attachment points to the lower frame and attachments for pulling devices.

FIG. 6 is a schematic top elevation view of the bucket/sled exercise apparatus attachment shown in FIG. 4.

As illustrated in FIG. 6, of the bucket/sled exercise apparatus attachment includes molded door 10, adjustable and retractable guides 11, lightweight sub-frame 12, and the non-abrasive feet/skis 13.

It is noted that the bucket/sled exercise apparatus attachment may have wheels, rollers, and/or bearings which are mounted to the sub-frame 12, to facilitate contact with the ground or floor.

It is further noted that the non-abrasive feet/skis 13, wheels, rollers, and/or bearings may be statically attached to the sub-frame 12.

It is also noted that the non-abrasive feet/skis 13, wheels, rollers, and/or bearings may be dynamically attached to the sub-frame 12 so to allow the non-abrasive feet/skis 13, wheels, rollers, and/or bearings to float with the terrain and/or floor.

The bucket/sled exercise apparatus attachment includes fitting arm receiving recesses 14 for the fitting arms 60 of the lower frame 80, as illustrated in FIG. 2.

Although FIG. 6 illustrates the fitting arms as being projections from the lower frame that are received by the bucket/sled exercise apparatus attachment at fitting arm receiving recesses 14, the bucket/sled exercise apparatus attachment may have projecting fitting arms and the lower frame have fitting arm receiving recesses for engaging the fitting arms.

Mounted to the lower sub-frame 12 are fastener elements 15, which may receive chains/ropes 41 for pulling the bucket/sled exercise apparatus attachment, enabling the bucket/sled exercise apparatus attachment to be utilized as a push, pull, or drag sled, and/or a means for carrying/transporting objects.

It is noted that the fastener elements 15 may also receive various forms of resistance tubing and other resistance training equipment, enabling resistance training.

Figure 7:
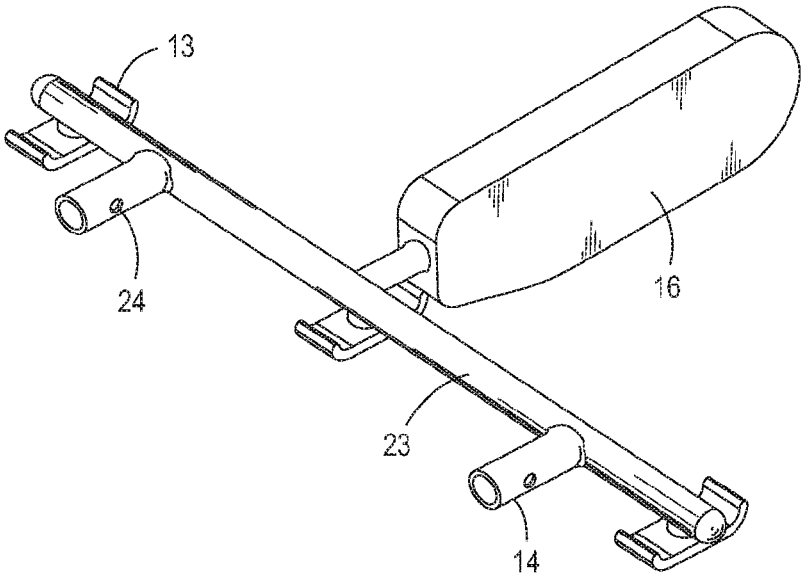
FIG. 7 illustrates a schematic view of a manipulative striking apparatus attachment, showing attachment points to the lower frame and gliding skis.

FIG. 7 is a schematic view of a manipulative striking apparatus attachment for the exercise apparatus of FIG. 1. The manipulative striking apparatus attachment can be utilized to strike, push, and/or manipulate various objects on or near the floor with club/paddle portion 16.

The manipulative striking apparatus attachment includes a frame 23, attached non-abrasive feet/skis 13, fitting arm receiving recesses 14, and fitting arm attachment points 24 for engaging the fitting arms 60 of the lower frame 80 of FIG. 2.

It is noted that the manipulative striking apparatus attachment may have wheels, rollers, and/or bearings which are mounted to the manipulative striking apparatus attachment, to facilitate contact with the ground or floor.

It is further noted that the non-abrasive feet/skis 13, wheels, rollers, and/or bearings may be statically attached to the manipulative striking apparatus attachment.

It is also noted that the non-abrasive feet/skis 13, wheels, rollers, and/or bearings may be dynamically attached to the manipulative striking apparatus attachment so to allow the non-abrasive feet/skis 13, wheels, rollers, and/or bearings to float with the terrain and/or floor.

Although FIG. 7 illustrates the fitting arms as being projections from the lower frame that are received by the manipulative striking apparatus attachment at attachment points 24, the manipulative striking apparatus attachment may have projecting fitting arms and the lower frame have fitting arm receiving recesses for engaging the fitting arms.

Figure 8:
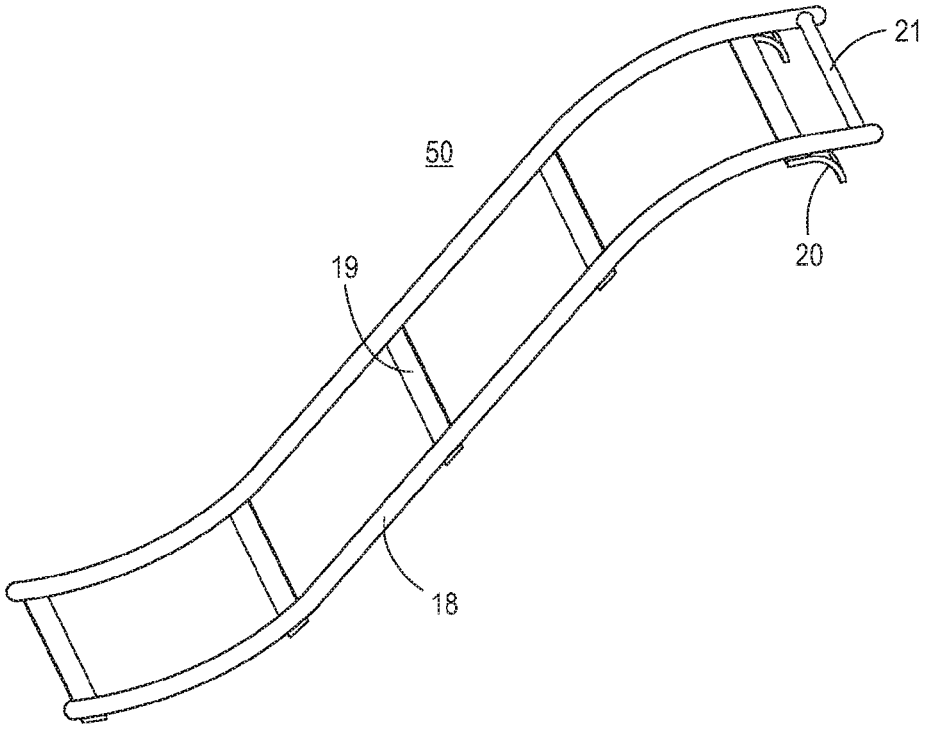
FIG. 8 illustrates a schematic view of a manipulative ramp apparatus attachment, showing attachment points to the upper or lower frame.

FIG. 8 illustrates a schematic view of a manipulative ramp apparatus attachment 50 for the exercise apparatus of FIG. 1. The manipulative ramp apparatus attachment 50 includes ramp rails 18 and horizontal ramp rail supports 19 that provide rigidity for the manipulative ramp apparatus attachment 50.

As illustrated in FIG. 8, the manipulative ramp apparatus attachment 50 includes resting platform 21 where an individual can rest or hold objects that are ready to be rolled, slid, or manipulated by the manipulative ramp apparatus attachment 50. Curved attachment points 20 rest or hook onto a horizontal support of the upper frame 70 of FIG. 2.

It is noted that non-abrasive feet/skis, wheels, rollers, and/or bearings may be statically attached to the manipulative ramp apparatus attachment 50 where the manipulative ramp apparatus attachment 50 engages the floor.

It is further noted that non-abrasive feet/skis, wheels, rollers, and/or bearings may be dynamically attached to the manipulative ramp apparatus attachment 50 where the manipulative ramp apparatus attachment 50 engages the floor so to allow the non-abrasive feet/skis, wheels, rollers, and/or bearings to float with the terrain and/or floor.

Figure 9:
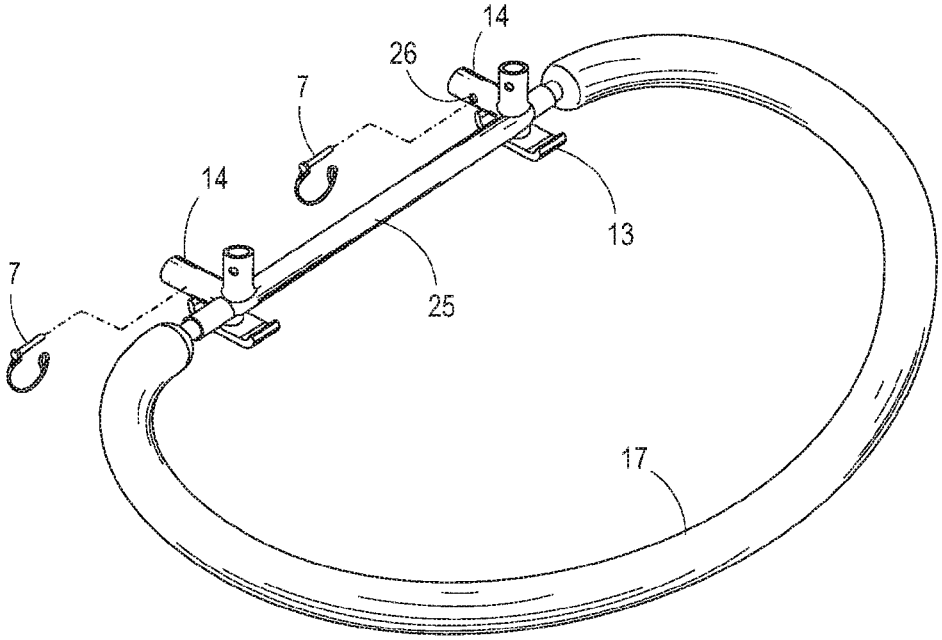
FIG. 9 illustrates a schematic view of a manipulative object controlling apparatus attachment, showing attachment points to the lower frame and the gliding skis and ring for controlling and manipulation of objects.

FIG. 9 is a schematic view of the manipulative object controlling apparatus attachment for the exercise apparatus of FIG. 1.

As illustrated in FIG. 9, the manipulative object controlling apparatus attachment includes frame 25, non-abrasive feet/skis 13, fitting arm receiving recesses 14, and fitting arm attachment points 26 for engaging the fitting arms 60 of the lower frame 80 of FIG. 2.

It is noted that the manipulative object controlling apparatus attachment may have wheels, rollers, and/or bearings which are mounted to the manipulative object controlling apparatus attachment, to facilitate contact with the ground or floor.

It is further noted that the non-abrasive feet/skis 13, wheels, rollers, and/or bearings may be statically attached to the manipulative object controlling apparatus attachment.

It is also noted that the non-abrasive feet/skis 13, wheels, rollers, and/or bearings may be dynamically attached to the manipulative object controlling apparatus attachment so to allow the non-abrasive feet/skis 13, wheels, rollers, and/or bearings to float with the terrain and/or floor.

As illustrated in FIG. 9, the manipulative object controlling apparatus attachment includes attaching pins 7 that attach the manipulative object controlling apparatus attachment to the lower frame 80 of FIG. 2. Manipulative control ring 17 control movement and transport of a multitude of objects, such as a ball.

Figure 10:
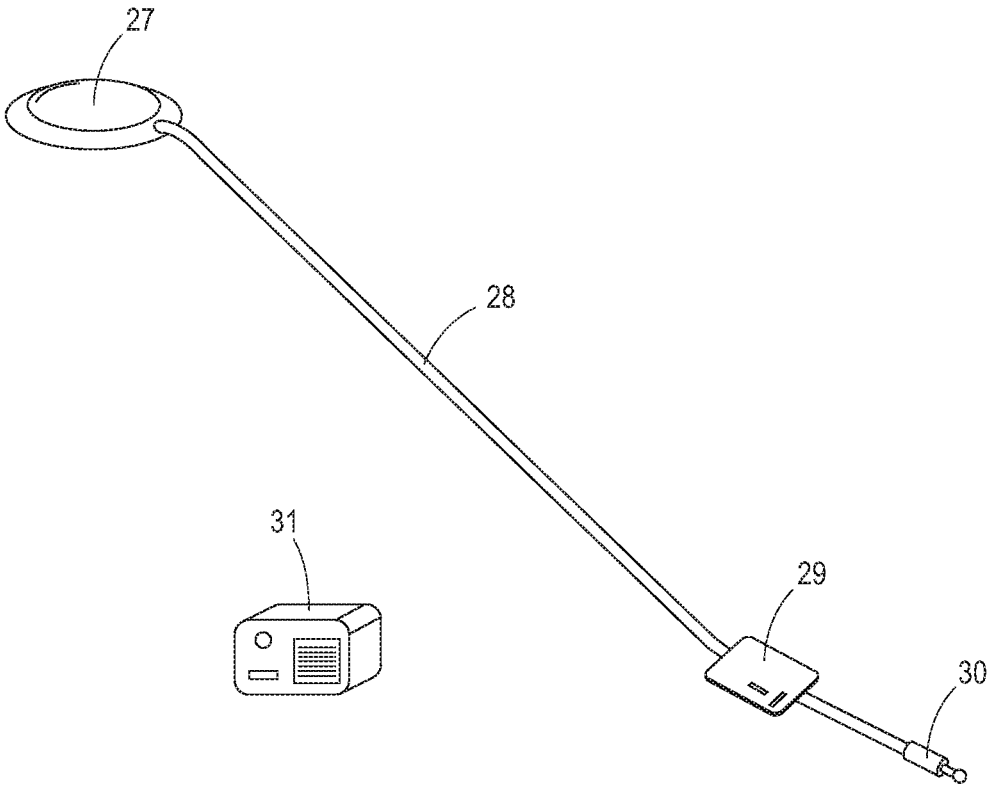
FIG. 10 illustrates a schematic view of basic wiring and control system for sound and relay switch devices.

FIG. 10 is a schematic view of a control system for sound and relay switch devices for the exercise apparatus of FIG. 1.

The exercise apparatus may utilize a switch button 27, mounted to upper frame of FIG. 1 (not shown) and wiring 28 that extends through the frame to a power source 29.

A wiring adapter 30 enables the switch button 27 to be utilized with electrical components of the various attachments described herein.

A sound device 31 can be also be included and activated by motion sensing, a push button, etc.

Figure 11:
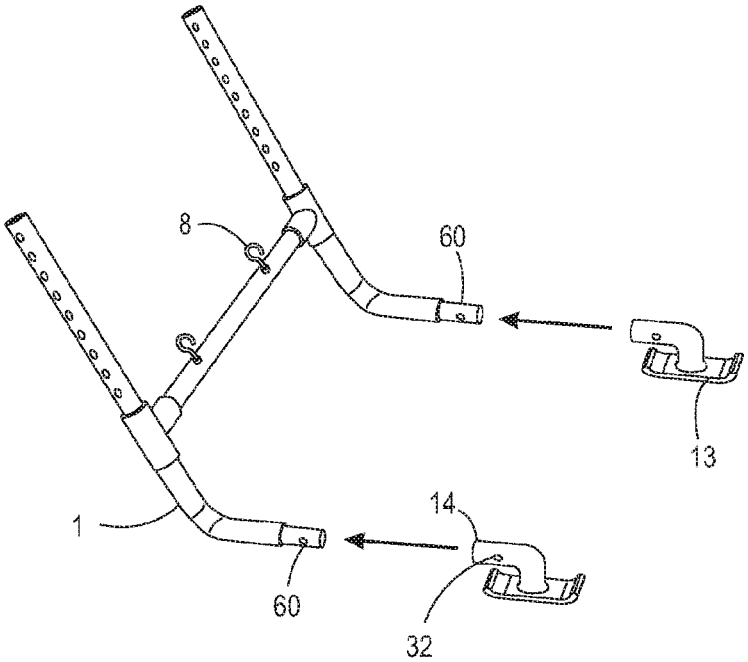
FIG. 11 illustrates a fragmentary side view of the lower frame and non-abrasive feet/ski adapters.

FIG. 11 illustrates the lower frame and fitting arms 60 coupling with non-abrasive feet/skis 13 through attachment points 32 of the non-abrasive feet/skis 13. Pins (not shown) may be used to secure the lower frame and fitting arms 60 with the non-abrasive feet/skis 13.

Figure 12:
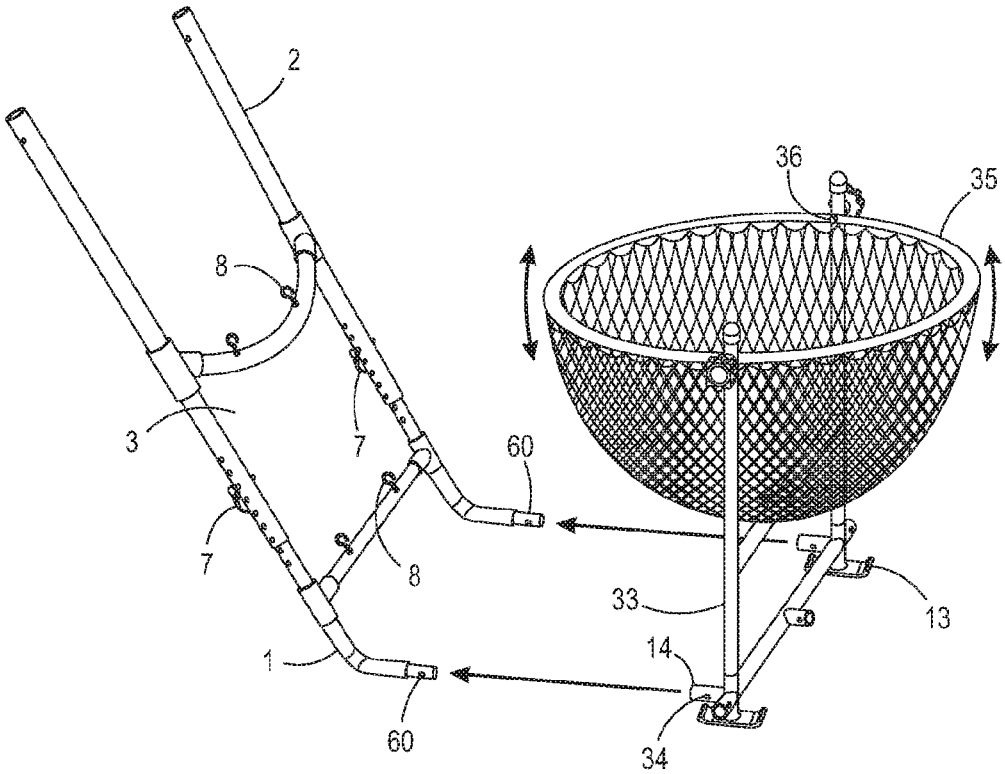
FIG. 12 illustrates a schematic side view of the lower frame, showing a hoop and net for basketball-type games and activities.

FIG. 12 is a schematic side view of the exercise apparatus of FIG. 1 and a hoop/net attachment. The hoop/net attachment can be utilized for basketball-type activities and games.

The hoop/net 35 is rotatable coupled to frame 33 by fasteners 36. The frame 33 includes attachment points 34 and non-abrasive feet/skis 13.

It is noted that the hoop/net may have wheels, rollers, and/or bearings which are mounted to the sub-frame 12, to facilitate contact with the ground or floor.

It is further noted that the non-abrasive feet/skis 13, wheels, rollers, and/or bearings may be statically attached to the hoop/net attachment.

It is also noted that the non-abrasive feet/skis 13, wheels, rollers, and/or bearings may be dynamically attached to the hoop/net attachment so to allow the non-abrasive feet/skis 13, wheels, rollers, and/or bearings to float with the terrain and/or floor.

The hoop/net 35 is attached to the lower frame via fitting arms 60. Pins (not shown) may be used to secure the fitting arms 60 with the hoop/net attachment.

Figure 13:
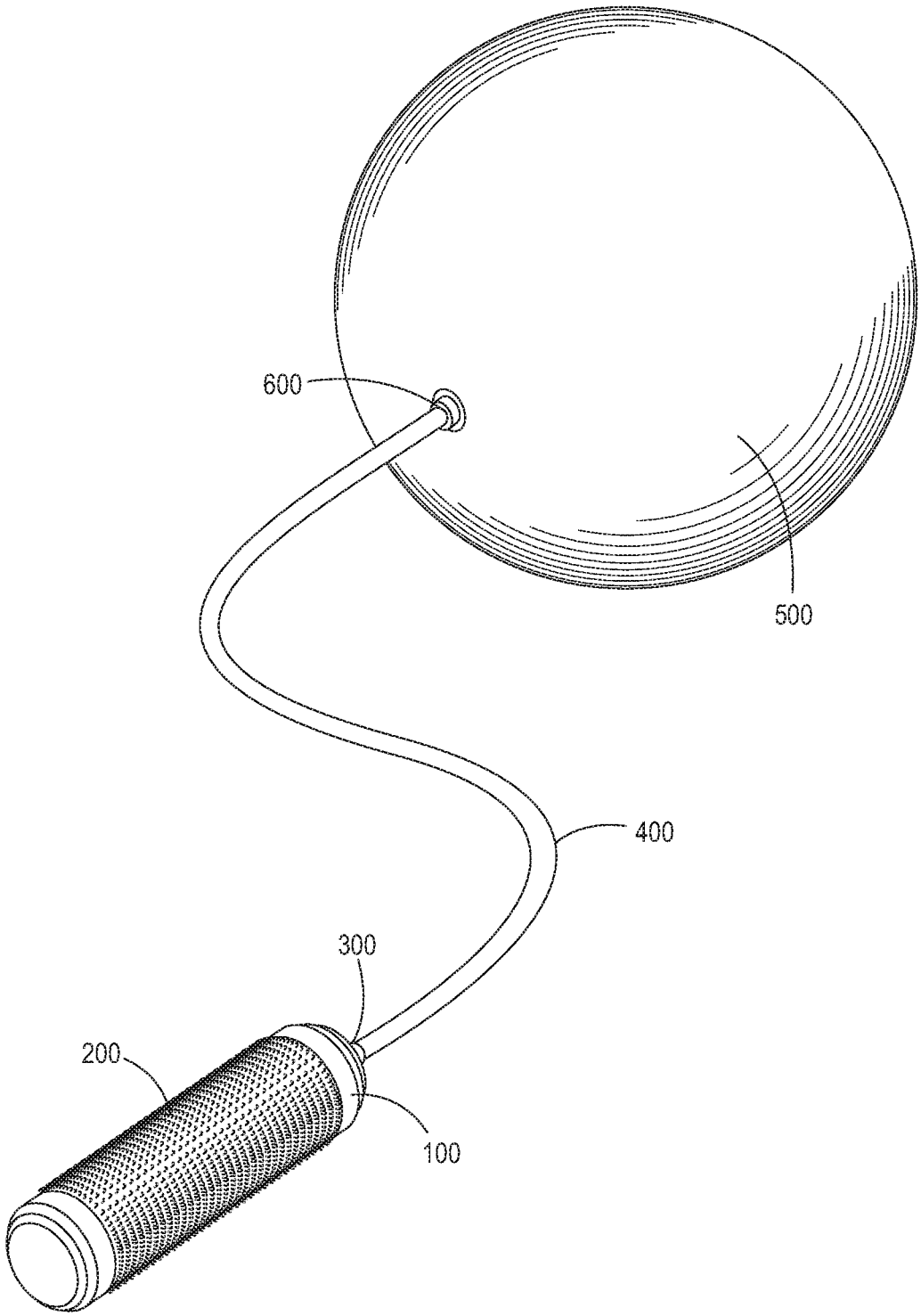
FIG. 13 illustrates a schematic side view of a jump rope simulator/trainer.

FIG. 13 illustrates that a jump rope simulator/trainer includes a handle 100 with an opening 300 for coupling the handle 100 to a flexible tubing 400. The jump rope simulator/trainer includes a soft sphere shaped object 500 with an opening 600 for coupling to an opposite end of the flexible tubing 400. As illustrated in FIG. 13, the handle 100 includes a hook and loop system 200.

Figure 14:
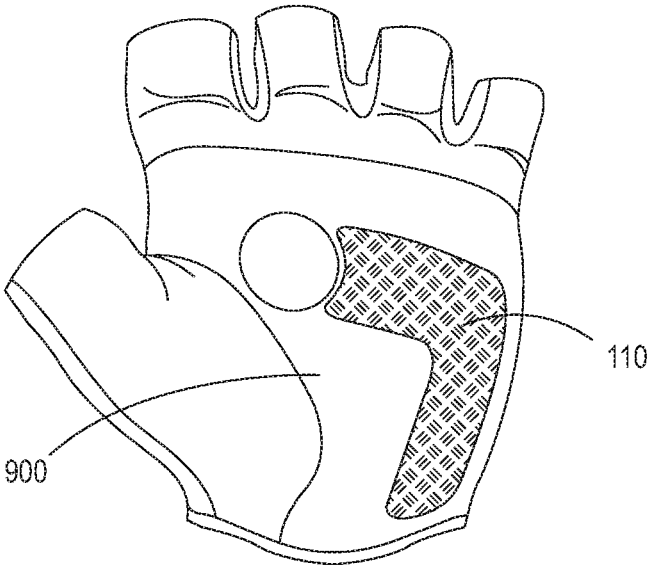
FIG. 14 illustrates a schematic view of a non-palm side of the jump rope simulator/trainer glove for grasping the jump rope simulator/trainer handle.

FIG. 14 illustrates a non-palm side of a soft fingerless glove 900. The soft fingerless glove 900 includes a cut out for the hook and loop adjustment strap 110, which enables the soft fingerless glove 900 to be fitted to various size hands.

Figure 15:
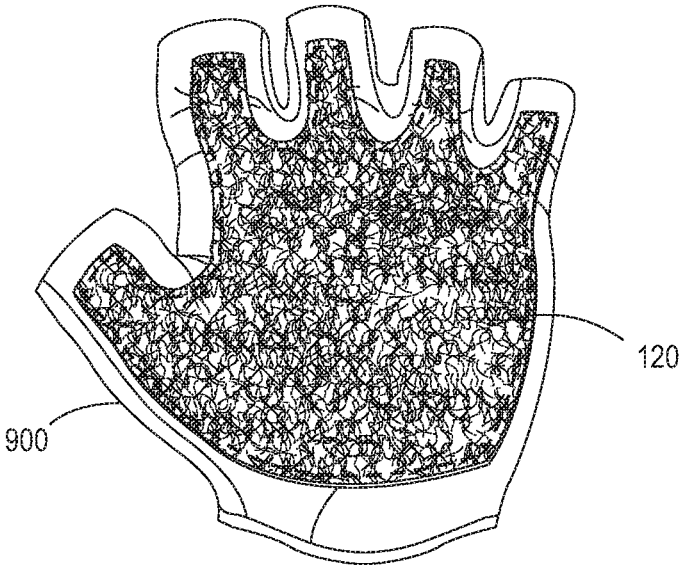
FIG. 15 illustrates a schematic view of a palm side of the jump rope simulator/trainer glove for grasping the jump rope simulator/trainer handle.

FIG. 15 illustrates a palm side of the soft fingerless glove 900. The soft fingerless glove 900 includes a hook and loop pattern 120, which couples with the hook and loop system 200 of handle 100 of FIG. 13.

Although the jump rope simulator/trainer of FIGS. 13, 14, and 15 shows a glove grasping apparatus detachable from the handle, it is noted that the glove grasping apparatus could be integrally formed with the handle.

Figure 16:
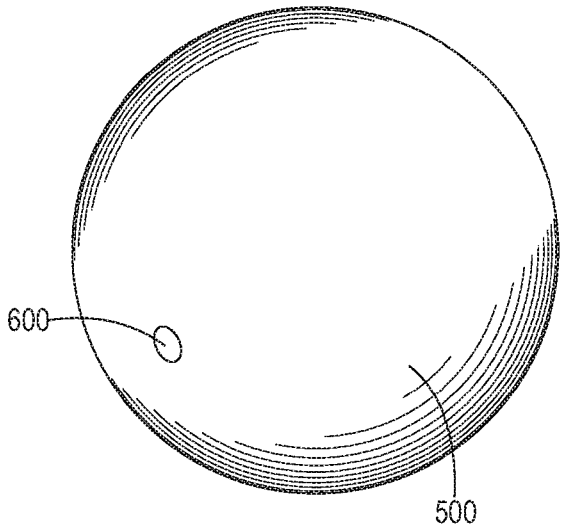
FIG. 16 illustrates a fragmentary view of the handle of a jump rope simulator/trainer, showing a hook and loop system.

FIG. 16 illustrates that a jump rope simulator/trainer includes a handle 100 with an opening 300 for coupling the handle 100 to flexible tubing. The handle 100 includes a hook and loop system 200.

Figure 17:
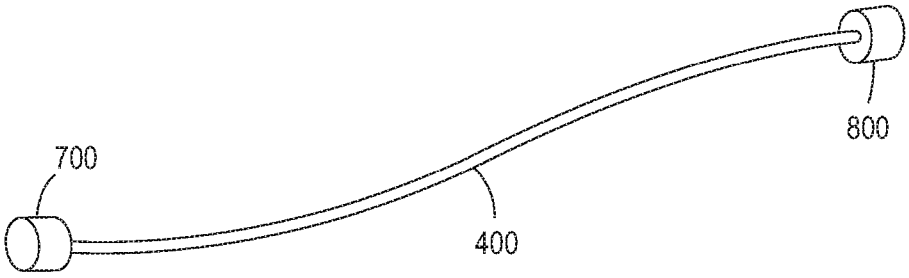
FIG. 17 illustrates a schematic view of a flexible base length of a jump rope simulator/trainer.

FIG. 17 Illustrates a flexible tubing 400, having fasteners 700 and 800. Fasteners 700 may couple with handle 100 of FIG. 16, and fastener 800, may couple with the soft sphere shaped object 500 of FIG. 13.

Figure 18:
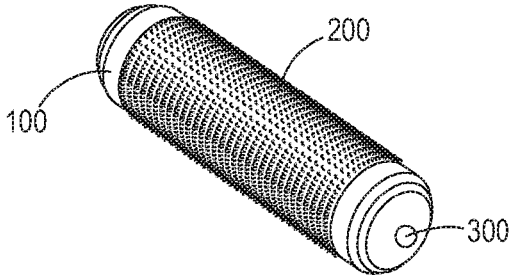
FIG. 18 illustrates a fragmentary side view of a soft sphere shaped object.

FIG. 18 Illustrates a soft sphere shaped object 500 having an opening 600 coupling with fastener 800 of FIG. 17.

Figure 19:
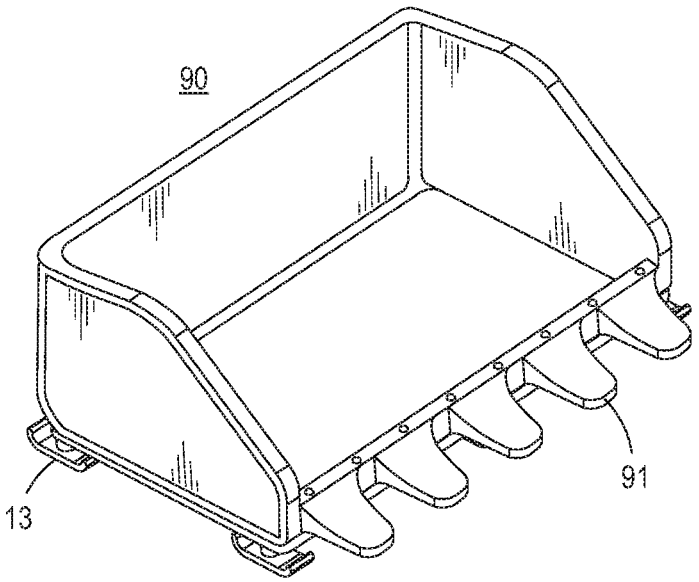
FIG. 19 illustrates a bucket/sled exercise apparatus attachment shaped as a loader bucket.

As illustrated FIG. 19, a bucket/sled exercise apparatus attachment 90 for the exercise apparatus of FIG. 1 may be shaped as a loader bucket (teeth 91), wherein objects or weight resistance can be added to or taken away from depending upon an individual's ability, activity, and/or task.

The loader bucket shaped exercise apparatus attachment 90 may have non-abrasive feet/skis 13, which are mounted to the frame, to facilitate contact with the ground or floor.

It is noted that the loader bucket shaped exercise apparatus attachment may have wheels, rollers, and/or bearings which are mounted to the frame, to facilitate contact with the ground or floor.

It is further noted that the non-abrasive feet/skis 13, wheels, rollers, and/or bearings may be statically attached to the loader bucket shaped exercise apparatus attachment 90.

It is also noted that the non-abrasive feet/skis 13, wheels, rollers, and/or bearings may be dynamically attached to the loader bucket shaped exercise apparatus attachment 90 so to allow the non-abrasive feet/skis 13, wheels, rollers, and/or bearings to float with the terrain and/or floor.

Figure 20:
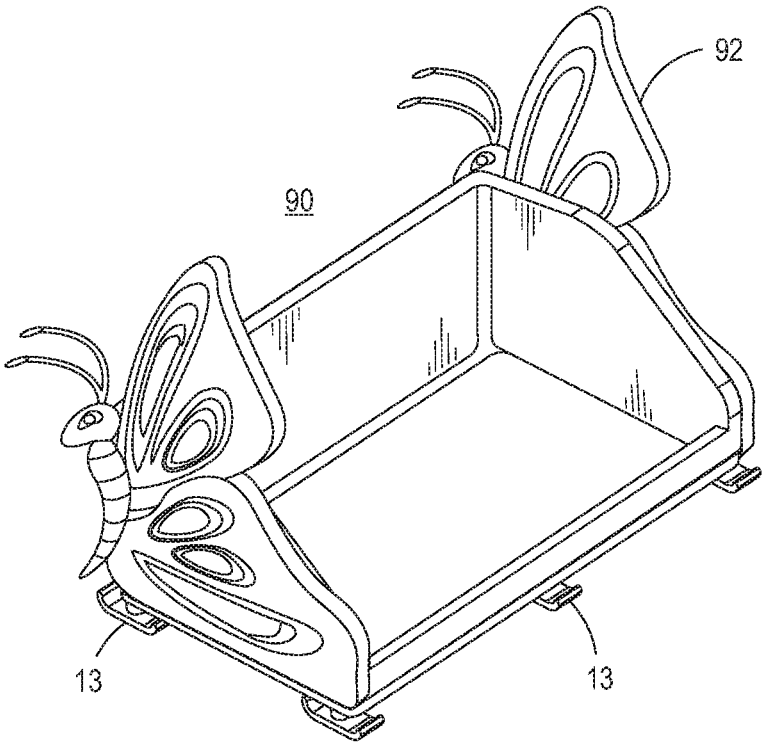
FIGS. 20-24 illustrate various examples of facades that can be attached to the bucket/sled exercise apparatus attachment of FIG. 4.

FIG. 20 illustrates a butterfly shaped façade 92 for the bucket/sled exercise apparatus attachment 90 of FIG. 4. The butterfly shaped façade 92 may be composed of a molded plastic, a fabric, or other material that can sustain a desired shape.

The butterfly shaped façade 92 is attached to the outside sidewalls of the frame of the bucket/sled exercise apparatus attachment 90 by the utilization of snaps or a loop/hook system.

It is noted that the butterfly shaped façade 92 can be easily interchangeable with other facades, thus the attachment mechanism facilitates attachment and detachment of the façade.

The bucket shaped exercise apparatus attachment 90 may have non-abrasive feet/skis 13, which are mounted to the frame, to facilitate contact with the ground or floor.

It is noted that the bucket shaped exercise apparatus attachment may have wheels, rollers, and/or bearings which are mounted to the frame, to facilitate contact with the ground or floor.

It is further noted that the non-abrasive feet/skis 13, wheels, rollers, and/or bearings may be statically attached to the bucket shaped exercise apparatus attachment 90.

It is also noted that the non-abrasive feet/skis 13, wheels, rollers, and/or bearings may be dynamically attached to the bucket shaped exercise apparatus attachment 90 so to allow the non-abrasive feet/skis 13, wheels, rollers, and/or bearings to float with the terrain and/or floor.

Although FIG. 20 illustrates a butterfly shaped façade 92, the façade may be any desired shape.

Figure 21:
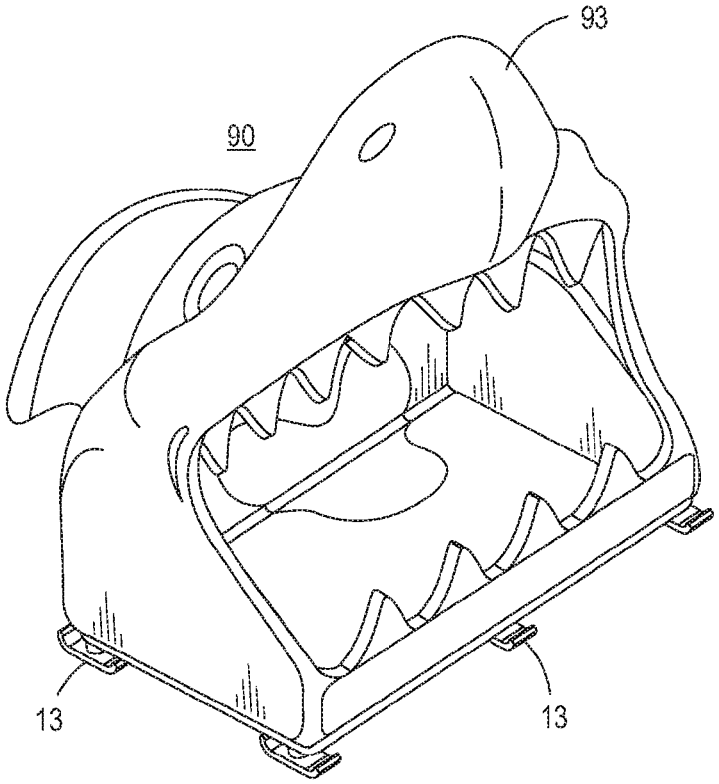

FIG. 21 illustrates a shark head shaped façade 93 for the bucket/sled exercise apparatus attachment 90 of FIG. 4. The shark head shaped façade 93 may be composed of a molded plastic, a fabric, or other material that can sustain a desired shape.

It is noted that if the shark head shaped façade 93 is composed of a fabric, the façade may include stiffening materials to keep the top of the façade from falling into the bucket/sled exercise apparatus attachment.

The shark head shaped façade 93 may be attached to the outside sidewalls of the frame of the bucket/sled exercise apparatus attachment by the utilization of snaps or a loop/hook system.

It is noted that if the shark head shaped façade 93 is composed of fabric, the shark head shaped façade may be secured to the bucket/sled exercise apparatus attachment with elastic material.

It is further noted that if the shark head shaped façade 93 is composed of a plastic material, the shark head shaped façade may have enough expansion to allow the façade to fit snuggly to the bucket/sled exercise apparatus attachment.

It is noted that the shark head shaped façade 93 can be easily interchangeable with other facades, thus the attachment mechanism facilitates attachment and detachment of the façade.

The bucket shaped exercise apparatus attachment 90 may have non-abrasive feet/skis 13, which are mounted to the frame, to facilitate contact with the ground or floor.

It is noted that the bucket shaped exercise apparatus attachment may have wheels, rollers, and/or bearings which are mounted to the frame, to facilitate contact with the ground or floor.

It is further noted that the non-abrasive feet/skis 13, wheels, rollers, and/or bearings may be statically attached to the bucket shaped exercise apparatus attachment 90.

It is also noted that the non-abrasive feet/skis 13, wheels, rollers, and/or bearings may be dynamically attached to the bucket shaped exercise apparatus attachment 90 so to allow the non-abrasive feet/skis 13, wheels, rollers, and/or bearings to float with the terrain and/or floor.

Although FIG. 21 illustrates a shark head shaped façade 93, the façade may be any desired shape.

Figure 22:
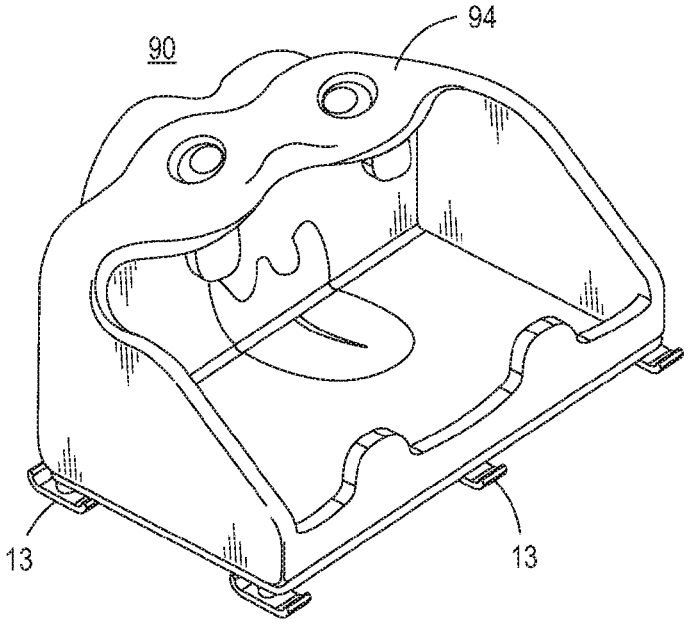

FIG. 22 illustrates a hippo/alligator/crocodile head shaped façade 94 for the bucket/sled exercise apparatus attachment of FIG. 4. The hippo/alligator/crocodile head shaped façade 94 may be composed of a molded plastic, a fabric, or other material that can sustain a desired shape.

It is noted that if the hippo/alligator/crocodile head shaped façade 94 is composed of a fabric, the façade may include stiffening materials to keep the top of the façade from falling into the bucket/sled exercise apparatus attachment.

The hippo/alligator/crocodile head shaped façade 94 may be attached to the outside sidewalls of the frame of the bucket/sled exercise apparatus attachment by the utilization of snaps or a loop/hook system.

It is noted that if the hippo/alligator/crocodile head shaped façade 94 is composed of fabric, the hippo/alligator/crocodile head shaped façade may be secured to the bucket/sled exercise apparatus attachment with elastic material.

It is further noted that if the hippo/alligator/crocodile head shaped façade 94 is composed of a plastic material, the hippo/alligator/crocodile head shaped façade 94 may have enough expansion to allow the façade to fit snuggly to the bucket/sled exercise apparatus attachment.

It is noted that the hippo/alligator/crocodile head shaped façade 94 can be easily interchangeable with other facades, thus the attachment mechanism facilitates attachment and detachment of the façade.

The bucket shaped exercise apparatus attachment 90 may have non-abrasive feet/skis 13, which are mounted to the frame, to facilitate contact with the ground or floor.

It is noted that the bucket shaped exercise apparatus attachment may have wheels, rollers, and/or bearings which are mounted to the frame, to facilitate contact with the ground or floor.

It is further noted that the non-abrasive feet/skis 13, wheels, rollers, and/or bearings may be statically attached to the bucket shaped exercise apparatus attachment 90.

It is also noted that the non-abrasive feet/skis 13, wheels, rollers, and/or bearings may be dynamically attached to the bucket shaped exercise apparatus attachment 90 so to allow the non-abrasive feet/skis 13, wheels, rollers, and/or bearings to float with the terrain and/or floor.

Although FIG. 22 illustrates a hippo/alligator/crocodile head shaped façade 94, the façade may be any desired shape.

Figure 23:
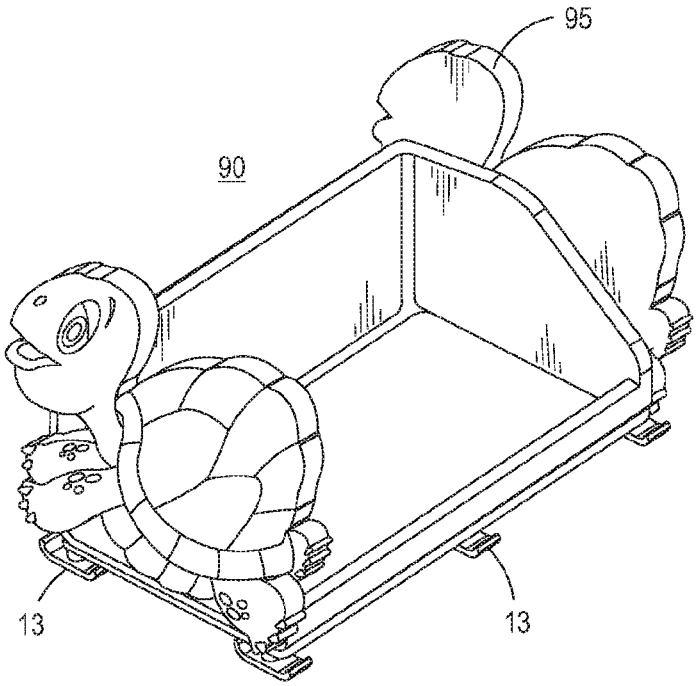

FIG. 23 illustrates a turtle shaped façade 95 for the bucket/sled exercise apparatus attachment of FIG. 4. The turtle shaped façade 95 may be composed of a molded plastic, a fabric, or other material that can sustain a desired shape.

The turtle shaped façade 95 is attached to the outside sidewalls of the frame of the bucket/sled exercise apparatus attachment by the utilization of snaps or a loop/hook system.

It is noted that the turtle shaped façade 95 can be easily interchangeable with other facades, thus the attachment mechanism facilitates attachment and detachment of the façade.

The bucket shaped exercise apparatus attachment 90 may have non-abrasive feet/skis 13, which are mounted to the frame, to facilitate contact with the ground or floor.

It is noted that the bucket shaped exercise apparatus attachment may have wheels, rollers, and/or bearings which are mounted to the frame, to facilitate contact with the ground or floor.

It is further noted that the non-abrasive feet/skis 13, wheels, rollers, and/or bearings may be statically attached to the bucket shaped exercise apparatus attachment 90.

It is also noted that the non-abrasive feet/skis 13, wheels, rollers, and/or bearings may be dynamically attached to the bucket shaped exercise apparatus attachment 90 so to allow the non-abrasive feet/skis 13, wheels, rollers, and/or bearings to float with the terrain and/or floor.

Although FIG. 23 illustrates a turtle shaped façade 95, the façade may be any desired shape.

Figure 24:
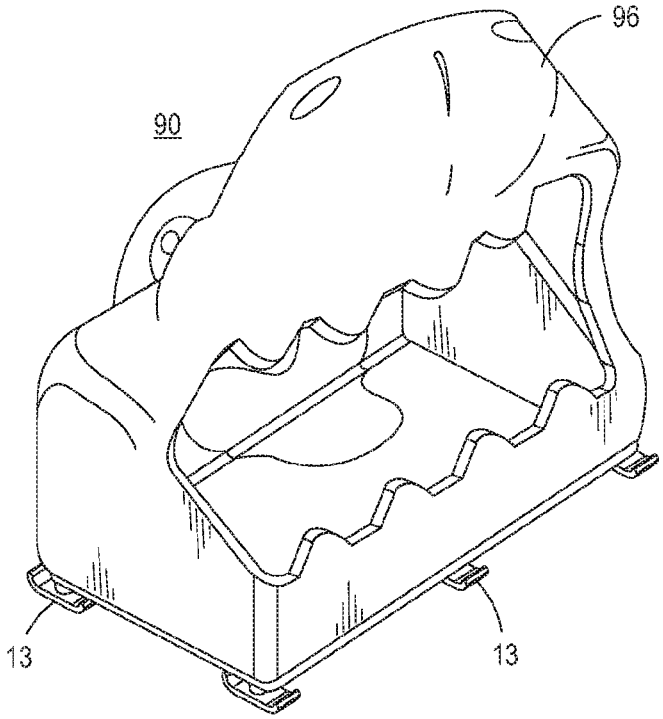

FIG. 24 illustrates a dinosaur head shaped façade 96 for the bucket/sled exercise apparatus attachment of FIG. 4. The dinosaur head shaped façade 96 may be composed of a molded plastic, a fabric, or other material that can sustain a desired shape.

It is noted that if the dinosaur head shaped façade 96 is composed of a fabric, the façade may include stiffening materials to keep the top of the façade from falling into the bucket/sled exercise apparatus attachment.

The dinosaur head shaped façade 96 may be attached to the outside sidewalls of the frame of the bucket/sled exercise apparatus attachment by the utilization of snaps or a loop/hook system.

It is noted that if the dinosaur head shaped façade 96 is composed of fabric, the dinosaur head shaped façade 96 may be secured to the bucket/sled exercise apparatus attachment with elastic material.

It is further noted that if the dinosaur head shaped façade 96 is composed of a plastic material, the dinosaur head shaped façade 96 may have enough expansion to allow the façade to fit snuggly to the bucket/sled exercise apparatus attachment.

It is noted that the dinosaur head shaped façade 96 can be easily interchangeable with other facades, thus the attachment mechanism facilitates attachment and detachment of the façade.

The bucket shaped exercise apparatus attachment 90 may have non-abrasive feet/skis 13, which are mounted to the frame, to facilitate contact with the ground or floor.

It is noted that the bucket shaped exercise apparatus attachment may have wheels, rollers, and/or bearings which are mounted to the frame, to facilitate contact with the ground or floor.

It is further noted that the non-abrasive feet/skis 13, wheels, rollers, and/or bearings may be statically attached to the bucket shaped exercise apparatus attachment 90.

It is also noted that the non-abrasive feet/skis 13, wheels, rollers, and/or bearings may be dynamically attached to the bucket shaped exercise apparatus attachment 90 so to allow the non-abrasive feet/skis 13, wheels, rollers, and/or bearings to float with the terrain and/or floor.

Although FIG. 24 illustrates a dinosaur head shaped façade 96, the façade may be any desired shape.

Figure 25:
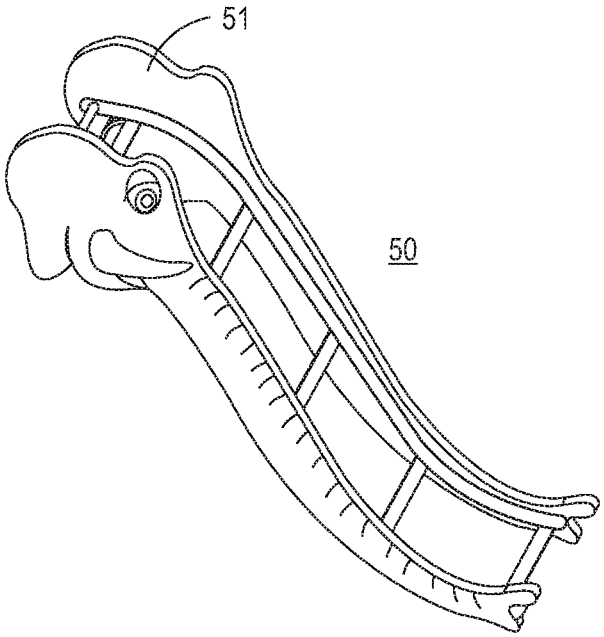
FIGS. 25-29 illustrate various examples of facades that can be attached to the manipulative ramp apparatus attachment of FIG. 8.

FIG. 25 illustrates an elephant head/trunk shaped façade 51 for the manipulative ramp apparatus attachment 50 of FIG. 8. The elephant head/trunk shaped façade 51 may be composed of a molded plastic, a fabric, or other material that can sustain a desired shape.

It is noted that the manipulative ramp apparatus attachment 50 of FIG. 8 may include additional external rails or other external means for attaching the façade thereto.

The elephant head/trunk shaped façade 51 may be attached to the additional external rails or other external means of the manipulative ramp apparatus attachment 50 by the utilization of snaps or a loop/hook system.

It is noted that if the elephant head/trunk shaped façade 51 is composed of a plastic material, the elephant head/trunk shaped façade 51 may have enough expansion to allow the façade to snap onto the external rails or other external means of the manipulative ramp apparatus attachment 50.

It is noted that the elephant head/trunk shaped façade 51 can be easily interchangeable with other facades, thus the attachment mechanism facilitates attachment and detachment of the façade.

It is further noted that non-abrasive feet/skis, wheels, rollers, and/or bearings may be statically attached to the manipulative ramp apparatus attachment 50.

It is also noted that the non-abrasive feet/skis, wheels, rollers, and/or bearings may be dynamically attached to the manipulative ramp apparatus attachment 50 so to allow the non-abrasive feet/skis, wheels, rollers, and/or bearings to float with the terrain and/or floor.

Although FIG. 25 illustrates an elephant head/trunk shaped façade 51, the façade may be any desired shape.

Figure 26:
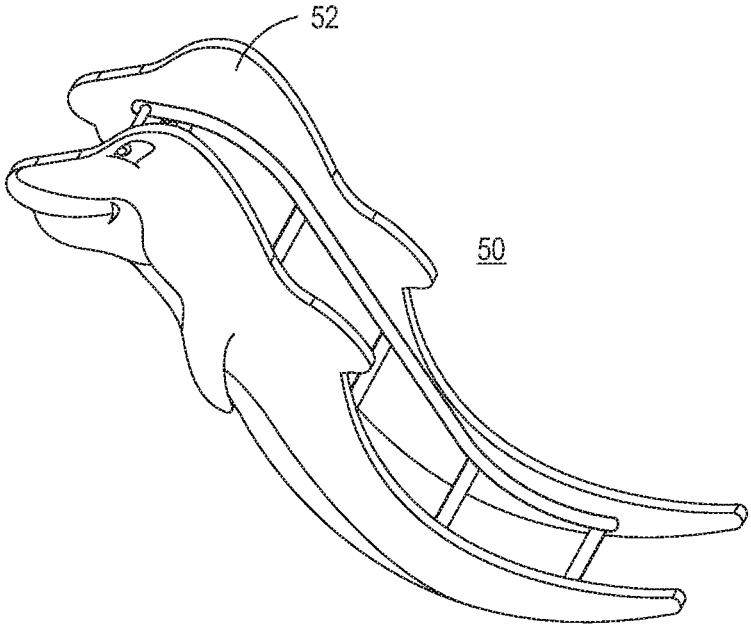

FIG. 26 illustrates a dolphin shaped façade 52 for the manipulative ramp apparatus attachment 50 of FIG. 8. The dolphin shaped façade 52 may be composed of a molded plastic, a fabric, or other material that can sustain a desired shape.

It is noted that the manipulative ramp apparatus attachment 50 of FIG. 8 may include additional external rails or other external means for attaching the façade thereto.

The dolphin shaped façade 52 may be attached to the additional external rails or other external means of the manipulative ramp apparatus attachment 50 by the utilization of snaps or a loop/hook system.

It is noted that if the dolphin shaped façade 52 is composed of a plastic material, the dolphin shaped façade 52 may have enough expansion to allow the façade to snap onto the external rails or other external means of the manipulative ramp apparatus attachment 50.

It is noted that the dolphin shaped façade 52 can be easily interchangeable with other facades, thus the attachment mechanism facilitates attachment and detachment of the façade.

It is further noted that non-abrasive feet/skis, wheels, rollers, and/or bearings may be statically attached to the manipulative ramp apparatus attachment 50.

It is also noted that the non-abrasive feet/skis, wheels, rollers, and/or bearings may be dynamically attached to the manipulative ramp apparatus attachment 50 so to allow the non-abrasive feet/skis, wheels, rollers, and/or bearings to float with the terrain and/or floor.

Although FIG. 26 illustrates a dolphin shaped façade 52, the façade may be any desired shape.

Figure 27:
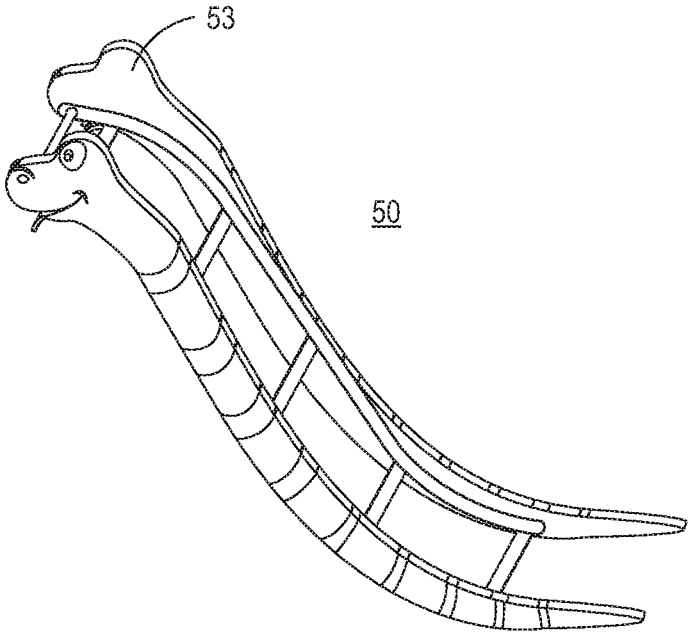

FIG. 27 illustrates a snake shaped façade 53 for the manipulative ramp apparatus attachment 50 of FIG. 8. The snake shaped façade 53 may be composed of a molded plastic, a fabric, or other material that can sustain a desired shape.

It is noted that the manipulative ramp apparatus attachment 50 of FIG. 8 may include additional external rails or other external means for attaching the façade thereto.

The snake shaped façade 53 may be attached to the additional external rails or other external means of the manipulative ramp apparatus attachment 50 by the utilization of snaps or a loop/hook system.

It is noted that if the snake shaped façade 53 is composed of a plastic material, the snake shaped façade 53 may have enough expansion to allow the façade to snap onto the external rails or other external means of the manipulative ramp apparatus attachment 50.

It is noted that the snake shaped façade 53 can be easily interchangeable with other facades, thus the attachment mechanism facilitates attachment and detachment of the façade.

It is further noted that non-abrasive feet/skis, wheels, rollers, and/or bearings may be statically attached to the manipulative ramp apparatus attachment 50.

It is also noted that the non-abrasive feet/skis, wheels, rollers, and/or bearings may be dynamically attached to the manipulative ramp apparatus attachment 50 so to allow the non-abrasive feet/skis, wheels, rollers, and/or bearings to float with the terrain and/or floor.

Although FIG. 27 illustrates a snake shaped façade 53, the façade may be any desired shape.

Figure 28:
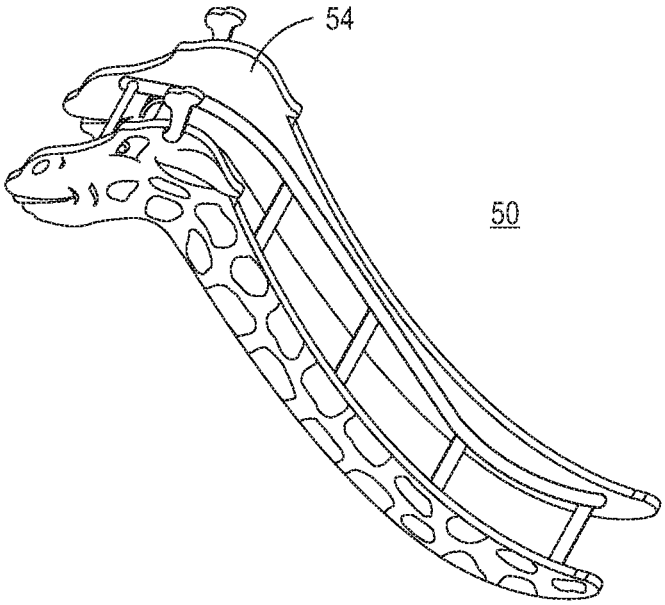

FIG. 28 illustrates a giraffe shaped façade 54 for the manipulative ramp apparatus attachment 50 of FIG. 8. The giraffe shaped façade 54 may be composed of a molded plastic, a fabric, or other material that can sustain a desired shape.

It is noted that the manipulative ramp apparatus attachment 50 of FIG. 8 may include additional external rails or other external means for attaching the façade thereto.

The giraffe shaped façade 54 may be attached to the additional external rails or other external means of the manipulative ramp apparatus attachment 50 by the utilization of snaps or a loop/hook system.

It is noted that if the giraffe shaped façade 54 is composed of a plastic material, the giraffe shaped façade 54 may have enough expansion to allow the façade to snap onto the external rails or other external means of the manipulative ramp apparatus attachment 50.

It is noted that the giraffe shaped façade 54 can be easily interchangeable with other facades, thus the attachment mechanism facilitates attachment and detachment of the façade.

It is further noted that non-abrasive feet/skis, wheels, rollers, and/or bearings may be statically attached to the manipulative ramp apparatus attachment 50.

It is also noted that the non-abrasive feet/skis, wheels, rollers, and/or bearings may be dynamically attached to the manipulative ramp apparatus attachment 50 so to allow the non-abrasive feet/skis, wheels, rollers, and/or bearings to float with the terrain and/or floor.

Although FIG. 28 illustrates a giraffe shaped façade 54, the façade may be any desired shape.

Figure 29:
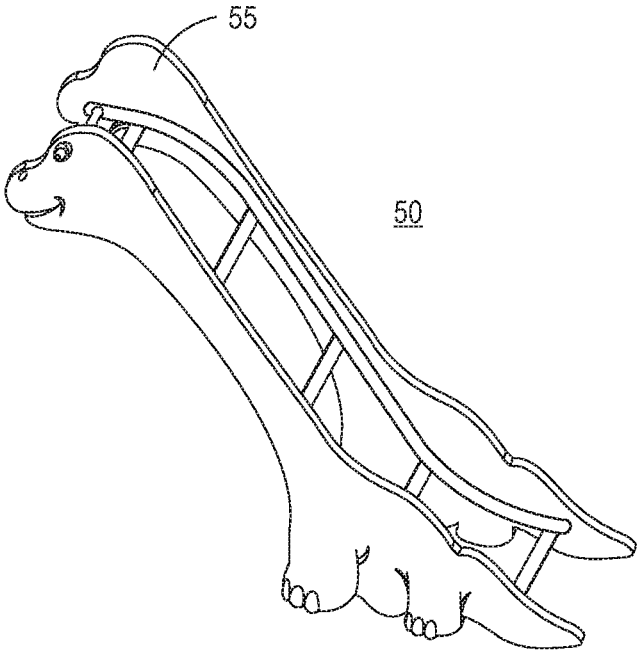

FIG. 29 illustrates a dinosaur shaped façade 55 for the manipulative ramp apparatus attachment 50 of FIG. 8. The dinosaur shaped façade 55 may be composed of a molded plastic, a fabric, or other material that can sustain a desired shape.

It is noted that the manipulative ramp apparatus attachment 50 of FIG. 8 may include additional external rails or other external means for attaching the façade thereto.

The dinosaur shaped façade 55 may be attached to the additional external rails or other external means of the manipulative ramp apparatus attachment 50 by the utilization of snaps or a loop/hook system.

It is noted that if the dinosaur shaped façade 55 is composed of a plastic material, the dinosaur shaped façade 55 may have enough expansion to allow the façade to snap onto the external rails or other external means of the manipulative ramp apparatus attachment 50.

It is noted that the dinosaur shaped façade 55 can be easily interchangeable with other facades, thus the attachment mechanism facilitates attachment and detachment of the façade.

Although FIG. 29 illustrates a dinosaur shaped façade 55, the façade may be any desired shape.

Figure 30:
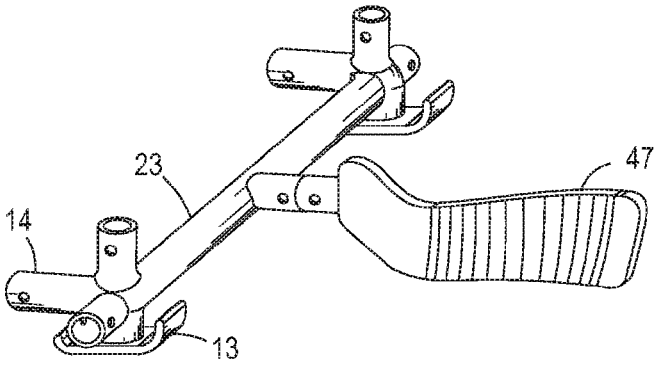
FIG. 30 illustrates a manipulative striking apparatus attachment shaped as a blade of a hockey stick.

FIG. 30 illustrates a manipulative striking apparatus attachment shaped as a blade 47 of a hockey stick in lieu of the manipulative striking apparatus attachment of FIG. 7. The manipulative striking apparatus attachment can be utilized to strike, push, and/or manipulate various objects on or near the floor with blade 47.

The manipulative striking apparatus attachment includes a frame 23, attached non-abrasive feet/skis 13, fitting arm receiving recesses 14 for engaging the fitting arms 60 of the lower frame 80 of FIG. 2.

It is noted that the manipulative striking apparatus attachment may have wheels, rollers, and/or bearings which are mounted to the manipulative striking apparatus attachment, to facilitate contact with the ground or floor.

It is further noted that the non-abrasive feet/skis 13, wheels, rollers, and/or bearings may be statically attached to the manipulative striking apparatus attachment.

It is also noted that the non-abrasive feet/skis 13, wheels, rollers, and/or bearings may be dynamically attached to the manipulative striking apparatus attachment so to allow the non-abrasive feet/skis 13, wheels, rollers, and/or bearings to float with the terrain and/or floor.

Although FIG. 30 illustrates the fitting arms as being projections from the lower frame that are received by the manipulative striking apparatus attachment, the manipulative striking apparatus attachment may have projecting fitting arms and the lower frame have fitting arm receiving recesses for engaging the fitting arms.

The manipulative striking apparatus attachment shaped as a blade 47 of a hockey stick may be composed of a molded plastic, a fabric, or other material that can sustain a desired shape.

It is noted that the manipulative striking apparatus attachment shaped as a blade 47 of a hockey stick may be attached to the lower frame of the exercise apparatus in the same manner as the manipulative striking apparatus attachment of FIG. 7.

It is further noted that the manipulative striking apparatus attachment shaped as a blade 47 of a hockey stick be a façade that attaches to the manipulative striking apparatus attachment of FIG. 7 by the utilization of snaps or a loop/hook system.

It is noted that if the blade 47 of a hockey stick shaped façade is composed of fabric, the blade 47 of a hockey stick shaped façade may be secured to the manipulative striking apparatus attachment with elastic material.

It is further noted that if the blade 47 of a hockey stick shaped façade is composed of a plastic material, the blade 47 of a hockey stick shaped façade may have enough expansion to allow the façade to fit snuggly to the manipulative striking apparatus attachment.

Although FIG. 30 illustrates a blade 47 of a hockey stick shaped façade, the façade may be any desired shape.

Figure 31:
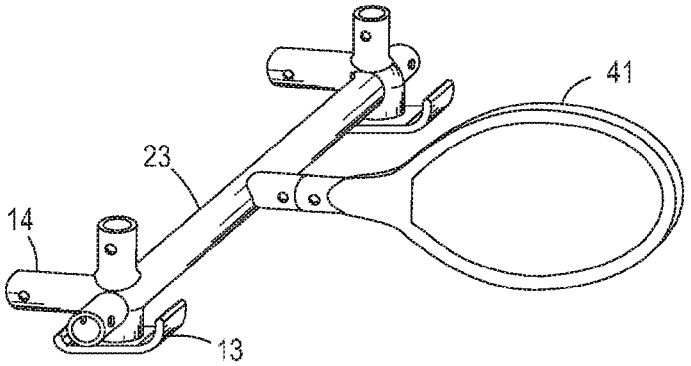
FIG. 31 illustrates a manipulative striking apparatus attachment shaped as a blade of a golf club.

FIG. 31 illustrates a manipulative striking apparatus attachment shaped as a paddle 41 in lieu of the manipulative striking apparatus attachment of FIG. 7. The manipulative striking apparatus attachment can be utilized to strike, push, and/or manipulate various objects on or near the floor with paddle 41.

The manipulative striking apparatus attachment includes a frame 23, attached non-abrasive feet/skis 13, fitting arm receiving recesses 14 for engaging the fitting arms 60 of the lower frame 80 of FIG. 2.

It is noted that the manipulative striking apparatus attachment may have wheels, rollers, and/or bearings which are mounted to the manipulative striking apparatus attachment, to facilitate contact with the ground or floor.

It is further noted that the non-abrasive feet/skis 13, wheels, rollers, and/or bearings may be statically attached to the manipulative striking apparatus attachment.

It is also noted that the non-abrasive feet/skis 13, wheels, rollers, and/or bearings may be dynamically attached to the manipulative striking apparatus attachment so to allow the non-abrasive feet/skis 13, wheels, rollers, and/or bearings to float with the terrain and/or floor.

Although FIG. 31 illustrates the fitting arms as being projections from the lower frame that are received by the manipulative striking apparatus attachment, the manipulative striking apparatus attachment may have projecting fitting arms and the lower frame have fitting arm receiving recesses for engaging the fitting arms.

The manipulative striking apparatus attachment shaped as a paddle 41 may be composed of a molded plastic, a fabric, or other material that can sustain a desired shape.

It is noted that the manipulative striking apparatus attachment shaped as a paddle 41 may be attached to the lower frame of the exercise apparatus in the same manner as the manipulative striking apparatus attachment of FIG. 7.

It is further noted that the manipulative striking apparatus attachment shaped as a paddle 41 be a façade that attaches to the manipulative striking apparatus attachment of FIG. 7 by the utilization of snaps or a loop/hook system.

It is noted that if the paddle shaped façade 41 is composed of fabric, the paddle shaped façade 41 may be secured to the manipulative striking apparatus attachment with elastic material.

It is further noted that if the paddle shaped façade 41 is composed of a plastic material, the paddle shaped façade 41 may have enough expansion to allow the façade to fit snuggly to the manipulative striking apparatus attachment.

Although FIG. 31 illustrates a paddle shaped façade 41, the façade may be any desired shape.

Figure 32:
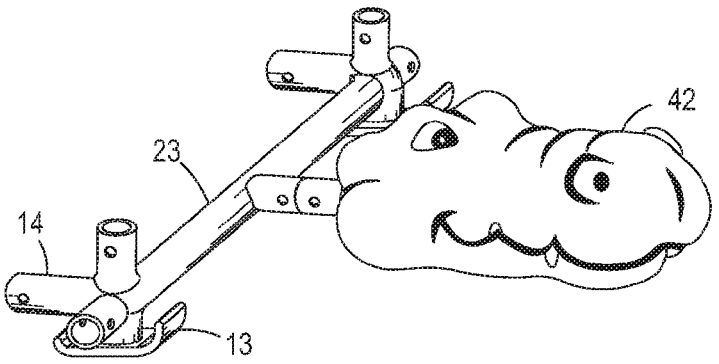
FIG. 32 illustrates a manipulative striking apparatus attachment shaped as a paddle.

FIG. 32 illustrates a manipulative striking apparatus attachment shaped as an alligator head 42 in lieu of the manipulative striking apparatus attachment of FIG. 7. The manipulative striking apparatus attachment can be utilized to strike, push, and/or manipulate various objects on or near the floor with alligator head 42.

The manipulative striking apparatus attachment includes a frame 23, attached non-abrasive feet/skis 13, fitting arm receiving recesses 14 for engaging the fitting arms 60 of the lower frame 80 of FIG. 2.

It is noted that the manipulative striking apparatus attachment may have wheels, rollers, and/or bearings which are mounted to the manipulative striking apparatus attachment, to facilitate contact with the ground or floor.

It is further noted that the non-abrasive feet/skis 13, wheels, rollers, and/or bearings may be statically attached to the manipulative striking apparatus attachment.

It is also noted that the non-abrasive feet/skis 13, wheels, rollers, and/or bearings may be dynamically attached to the manipulative striking apparatus attachment so to allow the non-abrasive feet/skis 13, wheels, rollers, and/or bearings to float with the terrain and/or floor.

Although FIG. 32 illustrates the fitting arms as being projections from the lower frame that are received by the manipulative striking apparatus attachment, the manipulative striking apparatus attachment may have projecting fitting arms and the lower frame have fitting arm receiving recesses for engaging the fitting arms.

The manipulative striking apparatus attachment shaped as an alligator head 42 may be composed of a molded plastic, a fabric, or other material that can sustain a desired shape.

It is noted that the manipulative striking apparatus attachment shaped as an alligator head 42 may be attached to the lower frame of the exercise apparatus in the same manner as the manipulative striking apparatus attachment of FIG. 7.

It is further noted that the manipulative striking apparatus attachment shaped as an alligator head 42 be a façade that attaches to the manipulative striking apparatus attachment of FIG. 7 by the utilization of snaps or a loop/hook system.

It is noted that if the alligator head shaped façade 42 is composed of fabric, the alligator head shaped façade 42 may be secured to the manipulative striking apparatus attachment with elastic material.

It is further noted that if the alligator head shaped façade 42 is composed of a plastic material, the alligator head shaped façade 42 may have enough expansion to allow the façade to fit snuggly to the manipulative striking apparatus attachment.

Although FIG. 32 illustrates an alligator head shaped façade 42, the façade may be any desired shape.

Figure 33:
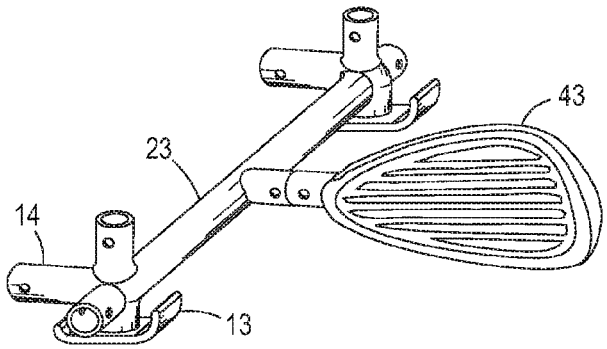
FIG. 33 illustrates a manipulative striking apparatus attachment shaped as a hand.

FIG. 33 illustrates a manipulative striking apparatus attachment shaped as a blade 43 of a golf club in lieu of the manipulative striking apparatus attachment of FIG. 7. The manipulative striking apparatus attachment can be utilized to strike, push, and/or manipulate various objects on or near the floor with blade 43.

The manipulative striking apparatus attachment includes a frame 23, attached non-abrasive feet/skis 13, fitting arm receiving recesses 14 for engaging the fitting arms 60 of the lower frame 80 of FIG. 2.

It is noted that the manipulative striking apparatus attachment may have wheels, rollers, and/or bearings which are mounted to the manipulative striking apparatus attachment, to facilitate contact with the ground or floor.

It is further noted that the non-abrasive feet/skis 13, wheels, rollers, and/or bearings may be statically attached to the manipulative striking apparatus attachment.

It is also noted that the non-abrasive feet/skis 13, wheels, rollers, and/or bearings may be dynamically attached to the manipulative striking apparatus attachment so to allow the non-abrasive feet/skis 13, wheels, rollers, and/or bearings to float with the terrain and/or floor.

Although FIG. 33 illustrates the fitting arms as being projections from the lower frame that are received by the manipulative striking apparatus attachment, the manipulative striking apparatus attachment may have projecting fitting arms and the lower frame have fitting arm receiving recesses for engaging the fitting arms.

The manipulative striking apparatus attachment shaped as a blade 43 of a golf club may be composed of a molded plastic, a fabric, or other material that can sustain a desired shape.

It is noted that the manipulative striking apparatus attachment shaped as a blade 43 of a golf club may be attached to the lower frame of the exercise apparatus in the same manner as the manipulative striking apparatus attachment of FIG. 7.

It is further noted that the manipulative striking apparatus attachment shaped as a blade 43 of a golf club be a façade that attaches to the manipulative striking apparatus attachment of FIG. 7 by the utilization of snaps or a loop/hook system.

It is noted that if the blade 43 of a golf club shaped façade is composed of fabric, the blade 43 of a golf club shaped façade may be secured to the manipulative striking apparatus attachment with elastic material.

It is further noted that if the blade 43 of a golf club shaped façade is composed of a plastic material, the blade 43 of a golf club shaped façade may have enough expansion to allow the façade to fit snuggly to the manipulative striking apparatus attachment.

Although FIG. 33 illustrates a blade 43 of a golf club shaped façade, the façade may be any desired shape.

Figure 34:
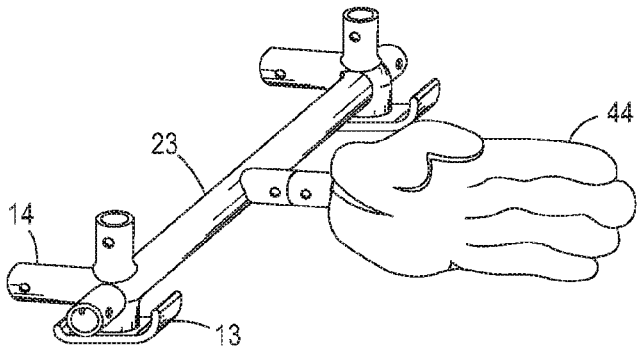
FIG. 34 illustrates a manipulative striking apparatus attachment shaped as a head of an animal.

FIG. 34 illustrates a manipulative striking apparatus attachment shaped as a hand 44 in lieu of the manipulative striking apparatus attachment of FIG. 7. The manipulative striking apparatus attachment can be utilized to strike, push, and/or manipulate various objects on or near the floor with hand 44.

The manipulative striking apparatus attachment includes a frame 23, attached non-abrasive feet/skis 13, fitting arm receiving recesses 14 for engaging the fitting arms 60 of the lower frame 80 of FIG. 2.

It is noted that the manipulative striking apparatus attachment may have wheels, rollers, and/or bearings which are mounted to the manipulative striking apparatus attachment, to facilitate contact with the ground or floor.

It is further noted that the non-abrasive feet/skis 13, wheels, rollers, and/or bearings may be statically attached to the manipulative striking apparatus attachment.

It is also noted that the non-abrasive feet/skis 13, wheels, rollers, and/or bearings may be dynamically attached to the manipulative striking apparatus attachment so to allow the non-abrasive feet/skis 13, wheels, rollers, and/or bearings to float with the terrain and/or floor.

Although FIG. 34 illustrates the fitting arms as being projections from the lower frame that are received by the manipulative striking apparatus attachment, the manipulative striking apparatus attachment may have projecting fitting arms and the lower frame have fitting arm receiving recesses for engaging the fitting arms.

The manipulative striking apparatus attachment shaped as a hand 44 may be composed of a molded plastic, a fabric, or other material that can sustain a desired shape.

It is noted that the manipulative striking apparatus attachment shaped as a hand 44 may be attached to the lower frame of the exercise apparatus in the same manner as the manipulative striking apparatus attachment of FIG. 7.

It is further noted that the manipulative striking apparatus attachment shaped as a hand 44 be a façade that attaches to the manipulative striking apparatus attachment of FIG. 7 by the utilization of snaps or a loop/hook system.

It is noted that if the hand shaped façade 44 is composed of fabric, the hand shaped façade 44 may be secured to the manipulative striking apparatus attachment with elastic material.

It is further noted that if the hand shaped façade 44 is composed of a plastic material, the hand shaped façade 44 may have enough expansion to allow the façade to fit snuggly to the manipulative striking apparatus attachment.

Although FIG. 34 illustrates a hand shaped façade 44, the façade may be any desired shape.

Figure 35:
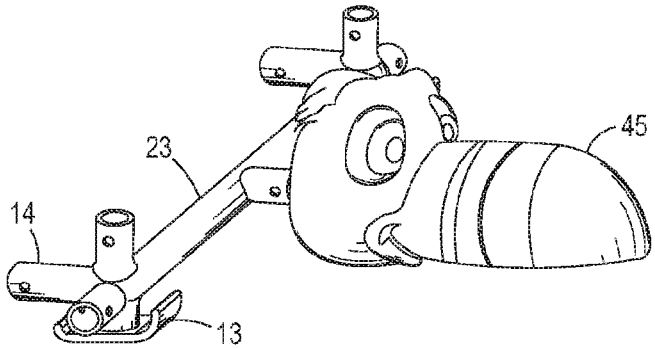
FIG. 35 illustrates a manipulative striking apparatus attachment shaped as a head of a bird.

FIG. 35 illustrates a manipulative striking apparatus attachment shaped as a bird head 45 in lieu of the manipulative striking apparatus attachment of FIG. 7. The manipulative striking apparatus attachment can be utilized to strike, push, and/or manipulate various objects on or near the floor with bird head 45.

The manipulative striking apparatus attachment includes a frame 23, attached non-abrasive feet/skis 13, fitting arm receiving recesses 14 for engaging the fitting arms 60 of the lower frame 80 of FIG. 2.

It is noted that the manipulative striking apparatus attachment may have wheels, rollers, and/or bearings which are mounted to the manipulative striking apparatus attachment, to facilitate contact with the ground or floor.

It is further noted that the non-abrasive feet/skis 13, wheels, rollers, and/or bearings may be statically attached to the manipulative striking apparatus attachment.

It is also noted that the non-abrasive feet/skis 13, wheels, rollers, and/or bearings may be dynamically attached to the manipulative striking apparatus attachment so to allow the non-abrasive feet/skis 13, wheels, rollers, and/or bearings to float with the terrain and/or floor.

Although FIG. 35 illustrates the fitting arms as being projections from the lower frame that are received by the manipulative striking apparatus attachment, the manipulative striking apparatus attachment may have projecting fitting arms and the lower frame have fitting arm receiving recesses for engaging the fitting arms.

The manipulative striking apparatus attachment shaped as a bird head 45 may be composed of a molded plastic, a fabric, or other material that can sustain a desired shape.

It is noted that the manipulative striking apparatus attachment shaped as a bird head 45 may be attached to the lower frame of the exercise apparatus in the same manner as the manipulative striking apparatus attachment of FIG. 7.

It is further noted that the manipulative striking apparatus attachment shaped as a bird head 45 be a façade that attaches to the manipulative striking apparatus attachment of FIG. 7 by the utilization of snaps or a loop/hook system.

It is noted that if the bird head shaped façade 45 is composed of fabric, the bird head shaped façade 45 may be secured to the manipulative striking apparatus attachment with elastic material.

It is further noted that if the bird head shaped façade 45 is composed of a plastic material, the bird head shaped façade 45 may have enough expansion to allow the façade to fit snuggly to the manipulative striking apparatus attachment.

Although FIG. 35 illustrates a bird head shaped façade 45, the façade may be any desired shape.

Figure 36:
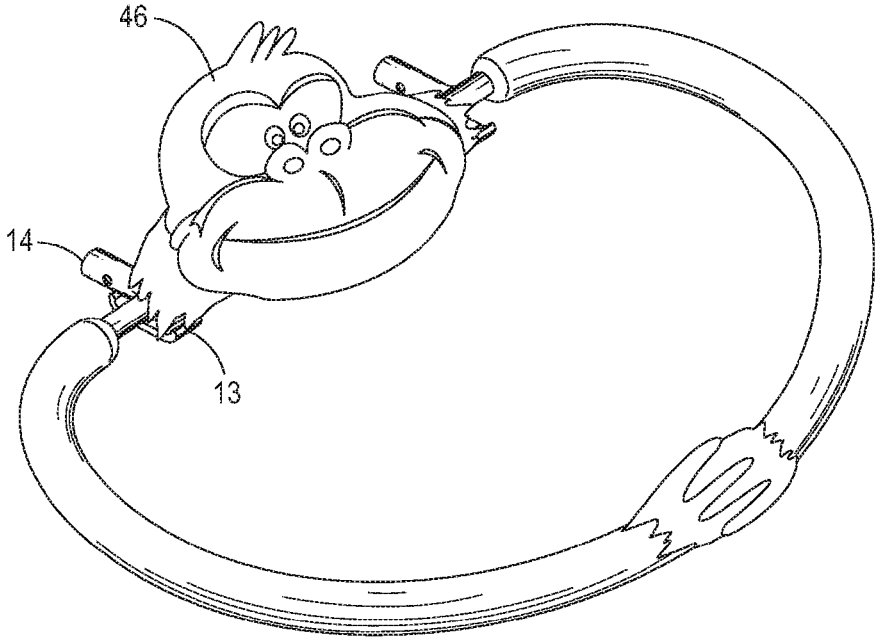
FIGS. 36-39 illustrate various examples of facades that can be attached to the manipulative object controlling apparatus attachment of FIG. 9.

FIG. 36 illustrates a monkey shaped façade 46 for the manipulative object controlling apparatus attachment of FIG. 9.

The manipulative object controlling apparatus attachment includes a frame 23, attached non-abrasive feet/skis 13, fitting arm receiving recesses 14 for engaging the fitting arms 60 of the lower frame 80 of FIG. 2.

It is noted that the manipulative object controlling apparatus attachment may have wheels, rollers, and/or bearings which are mounted to the manipulative object controlling apparatus attachment, to facilitate contact with the ground or floor.

It is further noted that the non-abrasive feet/skis 13, wheels, rollers, and/or bearings may be statically attached to the manipulative object controlling apparatus attachment.

It is also noted that the non-abrasive feet/skis 13, wheels, rollers, and/or bearings may be dynamically attached to the manipulative object controlling apparatus attachment so to allow the non-abrasive feet/skis 13, wheels, rollers, and/or bearings to float with the terrain and/or floor.

Although FIG. 36 illustrates the fitting arms as being projections from the lower frame that are received by the manipulative object controlling apparatus attachment, the manipulative object controlling apparatus attachment may have projecting fitting arms and the lower frame have fitting arm receiving recesses for engaging the fitting arms.

The monkey shaped façade 46 may be composed of a molded plastic, a fabric, or other material that can sustain a desired shape.

The monkey shaped façade 46 may be attached to the ring of the manipulative object controlling apparatus attachment by the utilization of snaps or a loop/hook system.

It is noted that if the monkey head shaped façade 46 is composed of fabric, the monkey shaped façade 46 may be secured to the ring of manipulative object controlling apparatus attachment with elastic material.

It is further noted that if the monkey shaped façade 46 is composed of a plastic material, the monkey shaped façade 46 may have enough expansion to allow the façade to fit snuggly to the ring of the manipulative object controlling apparatus attachment.

It is noted that the monkey shaped façade 46 can be easily interchangeable with other facades, thus the attachment mechanism facilitates attachment and detachment of the façade.

Although FIG. 36 illustrates a monkey shaped façade 46, the façade may be any desired shape.

Figure 37:
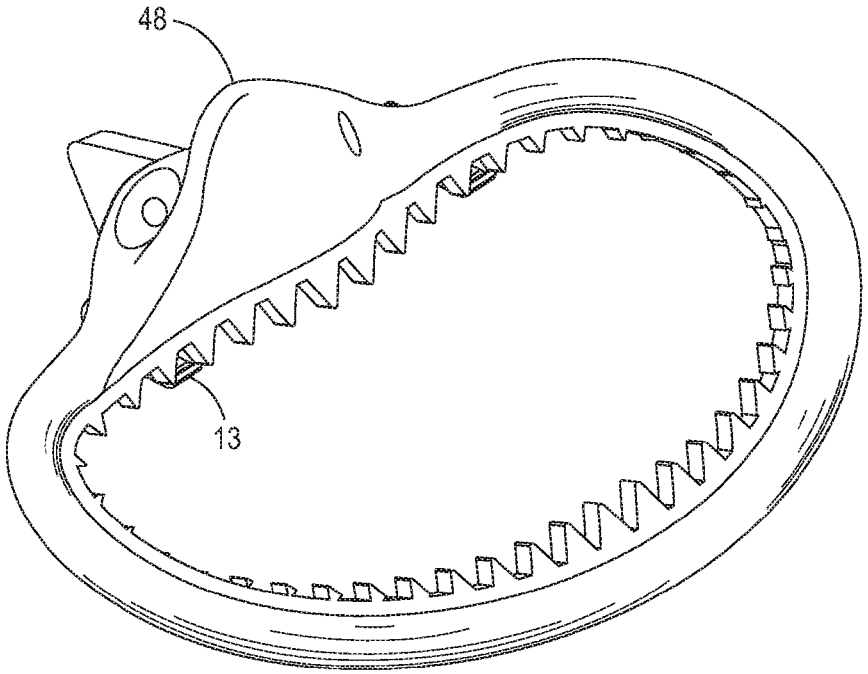

FIG. 37 illustrates a shark mouth shaped façade 48 for the manipulative object controlling apparatus attachment of FIG. 9.

The manipulative object controlling apparatus attachment includes a frame 23, attached non-abrasive feet/skis 13, fitting arm receiving recesses 14 for engaging the fitting arms 60 of the lower frame 80 of FIG. 2.

It is noted that the manipulative object controlling apparatus attachment may have wheels, rollers, and/or bearings which are mounted to the manipulative object controlling apparatus attachment, to facilitate contact with the ground or floor.

It is further noted that the non-abrasive feet/skis 13, wheels, rollers, and/or bearings may be statically attached to the manipulative object controlling apparatus attachment.

It is also noted that the non-abrasive feet/skis 13, wheels, rollers, and/or bearings may be dynamically attached to the manipulative object controlling apparatus attachment so to allow the non-abrasive feet/skis 13, wheels, rollers, and/or bearings to float with the terrain and/or floor.

Although FIG. 37 illustrates the fitting arms as being projections from the lower frame that are received by the manipulative object controlling apparatus attachment, the manipulative object controlling apparatus attachment may have projecting fitting arms and the lower frame have fitting arm receiving recesses for engaging the fitting arms.

The shark mouth shaped façade 48 may be composed of a molded plastic, a fabric, or other material that can sustain a desired shape.

The shark mouth shaped façade 48 may be attached to the ring of the manipulative object controlling apparatus attachment by the utilization of snaps or a loop/hook system.

It is noted that if the shark mouth head shaped façade 48 is composed of fabric, the shark mouth shaped façade 48 may be secured to the ring of manipulative object controlling apparatus attachment with elastic material.

It is further noted that if the shark mouth shaped façade 48 is composed of a plastic material, the shark mouth shaped façade 48 may have enough expansion to allow the façade to fit snuggly to the ring of the manipulative object controlling apparatus attachment.

It is noted that the shark mouth shaped façade 48 can be easily interchangeable with other facades, thus the attachment mechanism facilitates attachment and detachment of the façade.

Although FIG. 37 illustrates a shark mouth shaped façade 48, the façade may be any desired shape.

Figure 38:
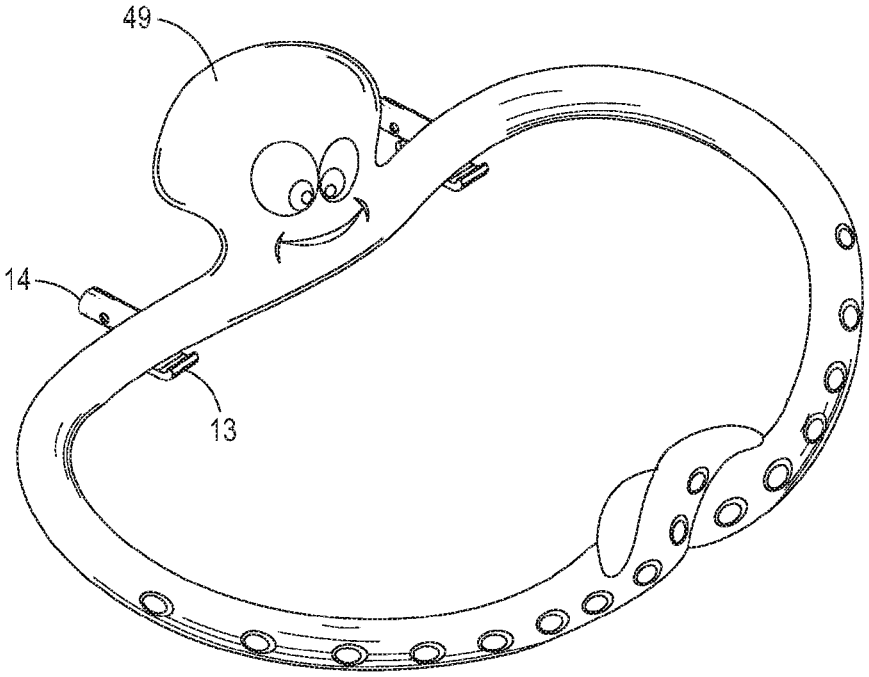

FIG. 38 illustrates an octopus shaped façade 49 for the manipulative object controlling apparatus attachment of FIG. 9.

The manipulative object controlling apparatus attachment includes a frame 23, attached non-abrasive feet/skis 13, fitting arm receiving recesses 14 for engaging the fitting arms 60 of the lower frame 80 of FIG. 2.

It is noted that the manipulative object controlling apparatus attachment may have wheels, rollers, and/or bearings which are mounted to the manipulative object controlling apparatus attachment, to facilitate contact with the ground or floor.

It is further noted that the non-abrasive feet/skis 13, wheels, rollers, and/or bearings may be statically attached to the manipulative object controlling apparatus attachment.

It is also noted that the non-abrasive feet/skis 13, wheels, rollers, and/or bearings may be dynamically attached to the manipulative object controlling apparatus attachment so to allow the non-abrasive feet/skis 13, wheels, rollers, and/or bearings to float with the terrain and/or floor.

Although FIG. 38 illustrates the fitting arms as being projections from the lower frame that are received by the manipulative object controlling apparatus attachment, the manipulative object controlling apparatus attachment may have projecting fitting arms and the lower frame have fitting arm receiving recesses for engaging the fitting arms.

The octopus shaped façade 49 may be composed of a molded plastic, a fabric, or other material that can sustain a desired shape.

The octopus shaped façade 49 may be attached to the ring of the manipulative object controlling apparatus attachment by the utilization of snaps or a loop/hook system.

It is noted that if the octopus head shaped façade 49 is composed of fabric, the octopus shaped façade 49 may be secured to the ring of manipulative object controlling apparatus attachment with elastic material.

It is further noted that if the octopus shaped façade 49 is composed of a plastic material, the octopus shaped façade 49 may have enough expansion to allow the façade to fit snuggly to the ring of the manipulative object controlling apparatus attachment.

It is noted that the octopus shaped façade 49 can be easily interchangeable with other facades, thus the attachment mechanism facilitates attachment and detachment of the façade.

Although FIG. 38 illustrates an octopus shaped façade 49, the façade may be any desired shape.

Figure 39:
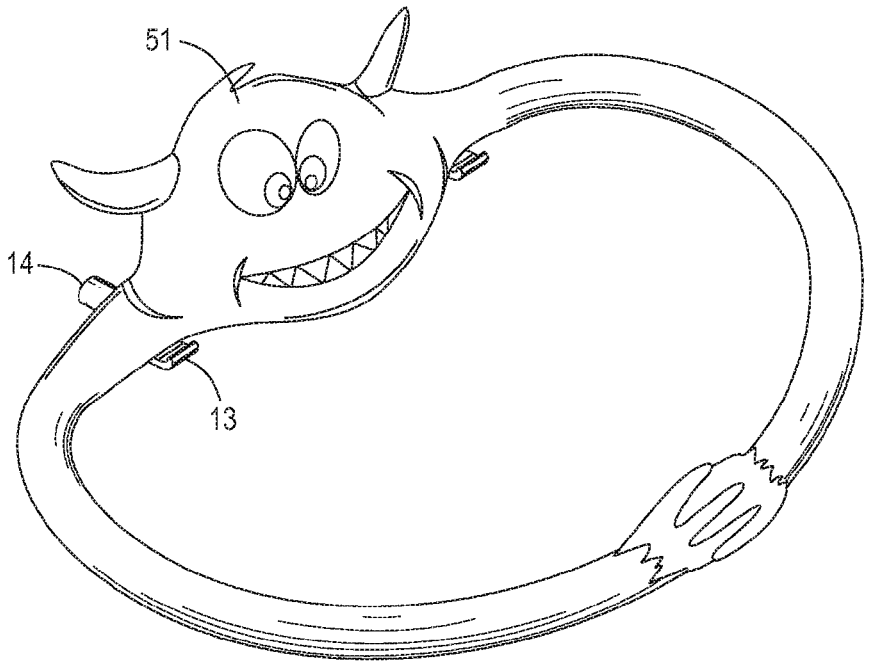

FIG. 39 illustrates a monster shaped façade 51 for the manipulative object controlling apparatus attachment of FIG. 9.

The manipulative object controlling apparatus attachment includes a frame 23, attached non-abrasive feet/skis 13, fitting arm receiving recesses 14 for engaging the fitting arms 60 of the lower frame 80 of FIG. 2.

It is noted that the manipulative object controlling apparatus attachment may have wheels, rollers, and/or bearings which are mounted to the manipulative object controlling apparatus attachment, to facilitate contact with the ground or floor.

It is further noted that the non-abrasive feet/skis 13, wheels, rollers, and/or bearings may be statically attached to the manipulative object controlling apparatus attachment.

It is also noted that the non-abrasive feet/skis 13, wheels, rollers, and/or bearings may be dynamically attached to the manipulative object controlling apparatus attachment so to allow the non-abrasive feet/skis 13, wheels, rollers, and/or bearings to float with the terrain and/or floor.

Although FIG. 39 illustrates the fitting arms as being projections from the lower frame that are received by the manipulative object controlling apparatus attachment, the manipulative object controlling apparatus attachment may have projecting fitting arms and the lower frame have fitting arm receiving recesses for engaging the fitting arms.

The monster shaped façade 51 may be composed of a molded plastic, a fabric, or other material that can sustain a desired shape.

The monster shaped façade 51 may be attached to the ring of the manipulative object controlling apparatus attachment by the utilization of snaps or a loop/hook system.

It is noted that if the monster head shaped façade 51 is composed of fabric, the monster shaped façade 51 may be secured to the ring of manipulative object controlling apparatus attachment with elastic material.

It is further noted that if the monster shaped façade 51 is composed of a plastic material, the monster shaped façade 51 may have enough expansion to allow the façade to fit snuggly to the ring of the manipulative object controlling apparatus attachment.

It is noted that the monster shaped façade 51 can be easily interchangeable with other facades, thus the attachment mechanism facilitates attachment and detachment of the façade.

Although FIG. 39 illustrates a monster shaped façade 51, the façade may be any desired shape.

Figure 40:
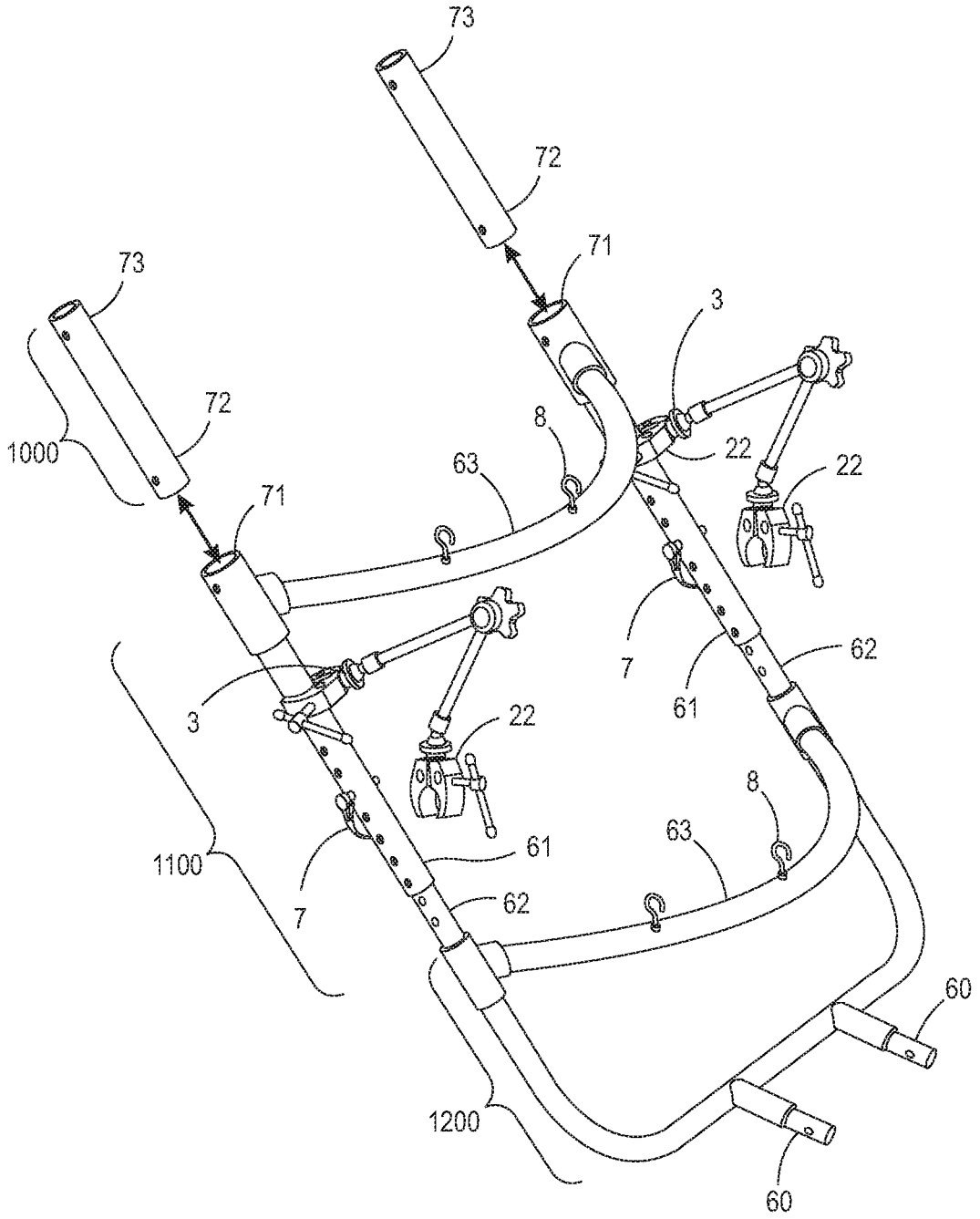
FIG. 40 illustrates a schematic view of another embodiment of an upper and lower frame of an exercise apparatus including curved horizontal supports.

As illustrated in FIG. 40, an exercise apparatus includes a lower frame section 1200, a middle frame section 1100, and an upper frame section 1000. The lower frame section 1200, middle frame section 1100, and upper frame section 1000 may be composed of rigid interconnecting tubes.

Although FIG. 40 illustrates lower frame section 1200, middle frame section 1100, and upper frame section 1000 being constructed of rigid interconnecting tubes, the frame sections may be constructed of any rigid lightweight material. Moreover, the frame sections need not be formed of tubes, but may have any geometric shape that allows interconnectability.

The lower frame section 1200 includes fitting arms 60, which are configured to receive various fitness and/or sport related skill attachments.

As illustrated in FIG. 40, the lower frame section 1200 and middle frame section 1100 include fastener elements 8 for attaching a variety of resistance tubing (as illustrated in FIG. 3) and weight resistance devices (not shown).

It is noted that the upper frame section 1000 include fastener elements 8 for attaching a variety of resistance tubing (as illustrated in FIG. 3) and weight resistance devices (not shown).

Although FIG. 40 illustrates the fitting arms 60 as being projections from the lower frame section 1200 that are received by an attachment, the attachment may have projecting fitting arms and the lower frame section 1200 has a receiving portion for engaging the fitting arms.

Moreover, the mechanism for connecting the lower frame section 1200 to the attachment may be any conventional connecting mechanism that facilitates connect and disconnect characteristics.

For example, the mechanism for connecting the lower frame section 1200 to the attachment may be a pin 7, as illustrated in FIG. 40. Moreover, the mechanism for connecting the lower frame section 1200 to the attachment may be a shear pin to protect the lower frame section 1200 and/or the attachment (not shown).

The lower frame section 1200 includes an incremental lower frame adjustment section 62 that includes points/holes. The middle frame section 1100 also includes an incremental middle frame adjustment section 61 that includes points/holes.

As illustrated in FIG. 40, the lower frame section 1200 is connected to the middle frame section 1100 by lining up holes in the incremental lower frame adjustment section 62 and incremental middle frame adjustment section 61 and inserting a pin 7 through the lined up holes. This allows the overall frame to be adjusted to accommodate individuals and equipment of various sizes.

Although FIG. 40 illustrates the exercise apparatus as being constructed of three detachable frames, the exercise apparatus may be an integral frame that is capable of expanding and contracting in length to facilitate connection to various assistive ambulation devices and to accommodate individuals and equipment of various sizes.

The lined up holes hold the lower frame section 1200 and middle frame section 1100 together by attaching pins 7. The fitting arms 60 hold the lower frame section 1200 to a fitness and/or sport related skill attachment (not shown) by using pins 7.

It is noted that although the attaching pins 7 have been illustrated as removable locking pins, it is noted that the incremental lower frame adjustment section 62 of the lower frame section 1200 or the incremental middle frame adjustment section 61 of the middle frame section 1100 may have built-in push pins that enables the securing of the lower frame section 1200 and middle frame section 1100 together.

It is further noted that the connecting mechanism for connecting the lower frame section 1200 and middle frame section 1100 may be any conventional connection mechanism that enables expanding and contracting in length to facilitate connection to various assistive ambulation devices and to accommodate individuals and equipment of various sizes.

FIG. 40 also illustrates an articulation system, which includes clamp 22 and articulation arm 3, which enables the exercise apparatus to be securely mounted to a wheelchair, walker, gait trainer, stander, and/or other assistive ambulation equipment.

Lastly, FIG. 40 illustrates curved horizontal support 63 connected between vertical sections of the lower frame section 1200 and middle frame section 1100. The fastener elements 8 are located on the curved horizontal support 63.

The curved horizontal supports (63) create a volume for the user to occupy, if needed, when using the exercise apparatus.

For example, the curved horizontal supports (63) may create a volume for the user's legs when the user is in a wheelchair.

FIG. 40 further illustrates that the upper frame section 1000 includes two vertical support sections having holes (72 and 73) at either end of each vertical support section. The vertical support sections engage the middle frame section 1100 at vertical support receiving recesses 71 of the middle frame section 1100.

As illustrated in FIG. 40, the upper frame section 1000 is connected to the middle frame section 1100 by lining up holes 72 in the upper frame section 1000 with holes in the vertical support receiving recesses 71 of the middle frame section 1100 and inserting a pin 7 through the lined up holes. This allows the overall frame to be adjusted to accommodate individuals and equipment of various sizes.

Although FIG. 40 illustrates the vertical support sections of the upper frame section 1000 being received by vertical support receiving recesses 71 of the middle frame section 1100, the middle frame section 1100 may have projecting sections and the upper frame section 1000 has a receiving portion for engaging the projecting sections.

It is noted that non-abrasive feet/skis, wheels, rollers, and/or bearings may be statically attached to the lower frame section 1200 near the fitting arms 60.

It is also noted that non-abrasive feet/skis, wheels, rollers, and/or bearings may be statically attached to a horizontal support of the lower frame section 1200, upon which the fitting arms 60 are located.

It is further noted that non-abrasive feet/skis, wheels, rollers, and/or bearings may be dynamically attached to the lower frame section 1200 near the fitting arms 60 so to allow the non-abrasive feet/skis, wheels, rollers, and/or bearings to float with the terrain and/or floor.

Lastly, it is noted that non-abrasive feet/skis, wheels, rollers, and/or bearings may be dynamically attached to a horizontal support of the lower frame section 1200, upon which the fitting arms 60 are located, so to allow the non-abrasive feet/skis, wheels, rollers, and/or bearings to float with the terrain and/or floor.

Figure 41:
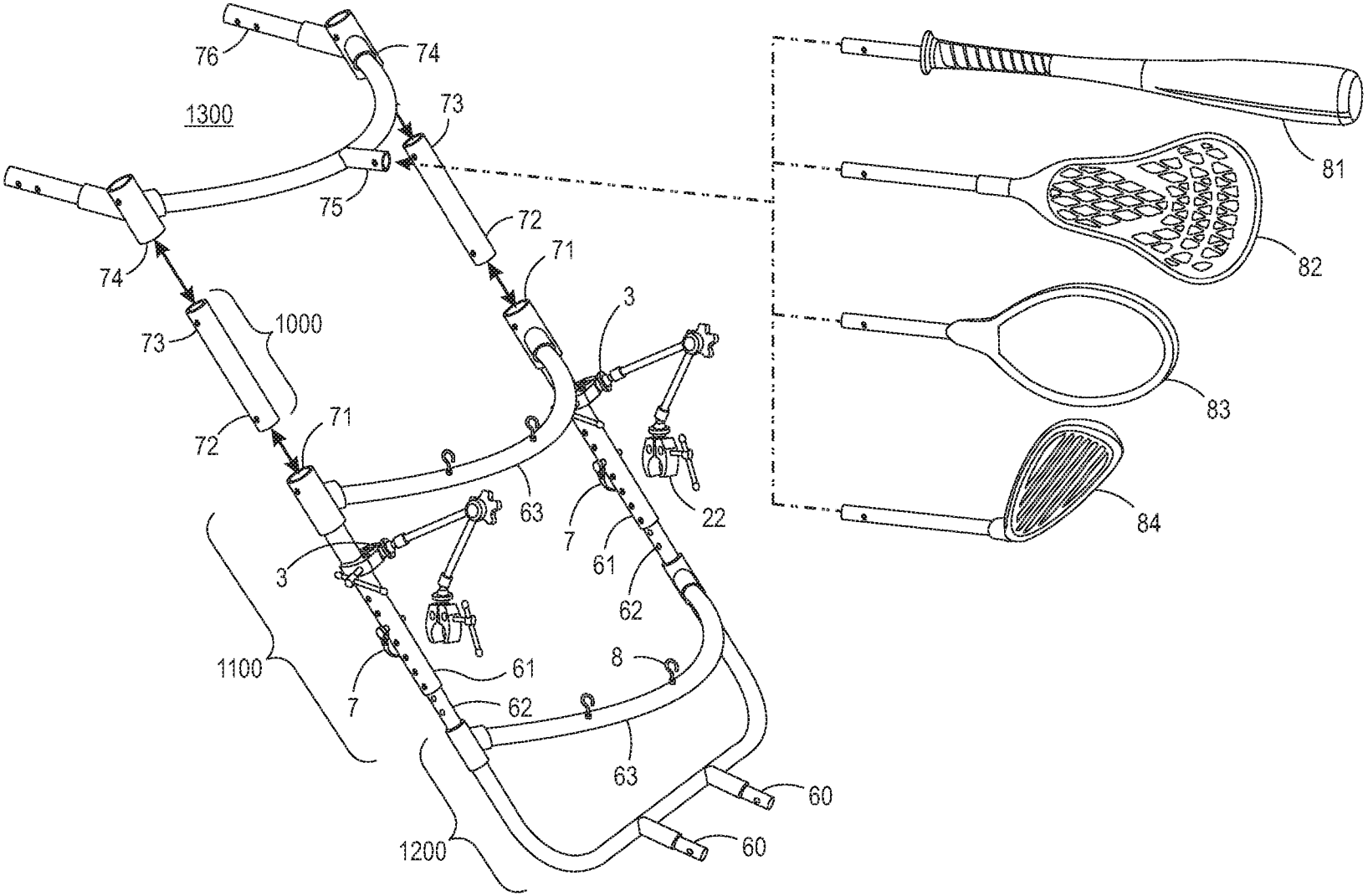
FIG. 41 illustrates a schematic view of another embodiment of an upper and lower frame of an exercise apparatus including curved horizontal supports with an accessory attachment mechanism.

As illustrated in FIG. 41, an exercise apparatus includes a lower frame section 1200, a middle frame section 1100, an upper frame section 1000, and a handle section 1300. The lower frame section 1200, middle frame section 1100, upper frame section 1000, and handle section 1300 may be composed of rigid interconnecting tubes.

Although FIG. 41 illustrates the lower frame section 1200, middle frame section 1100, upper frame section 1000, and handle section 1300 being constructed of rigid interconnecting tubes, the sections may be constructed of any rigid lightweight material. Moreover, the sections need not be formed of tubes, but may have any geometric shape that allows interconnectability.

The lower frame section 1200 includes fitting arms 60, which are configured to receive various fitness and/or sport related skill attachments.

As illustrated in FIG. 41, the lower frame section 1200 and middle frame section 1100 include fastener elements 8 for attaching a variety of resistance tubing (as illustrated in FIG. 3) and weight resistance devices (not shown).

It is noted that the upper frame section 1000 include fastener elements 8 for attaching a variety of resistance tubing (as illustrated in FIG. 3) and weight resistance devices (not shown).

Although FIG. 41 illustrates the fitting arms 60 as being projections from the lower frame section 1200 that are received by an attachment, the attachment may have projecting fitting arms and the lower frame section 1200 has a receiving portion for engaging the fitting arms.

Moreover, the mechanism for connecting the lower frame section 1200 to the attachment may be any conventional connecting mechanism that facilitates connect and disconnect characteristics.

For example, the mechanism for connecting the lower frame section 1200 to the attachment may be a pin 7, as illustrated in FIG. 40. Moreover, the mechanism for connecting the lower frame section 1200 to the attachment may be a shear pin to protect the lower frame section 1200 and/or the attachment (not shown).

The lower frame section 1200 includes an incremental lower frame adjustment section 62 that includes points/holes. The middle frame section 1100 also includes an incremental middle frame adjustment section 61 that includes points/holes.

As illustrated in FIG. 41, the lower frame section 1200 is connected to the middle frame section 1100 by lining up holes in the incremental lower frame adjustment section 62 and incremental middle frame adjustment section 61 and inserting a pin 7 through the lined up holes. This allows the overall frame to be adjusted to accommodate individuals and equipment of various sizes.

Although FIG. 41 illustrates the exercise apparatus as being constructed of three detachable frames, the exercise apparatus may be an integral frame that is capable of expanding and contracting in length to facilitate connection to various assistive ambulation devices and to accommodate individuals and equipment of various sizes.

The lined up holes hold the lower frame section 1200 and middle frame section 1100 together by attaching pins 7. The fitting arms 60 hold the lower frame section 1200 to a fitness and/or sport related skill attachment (not shown) by using pins 7.

It is noted that although the attaching pins 7 have been illustrated as removable locking pins, it is noted that the incremental lower frame adjustment section 62 of the lower frame section 1200 or the incremental middle frame adjustment section 61 of the middle frame section 1100 may have built-in push pins that enables the securing of the lower frame section 1200 and middle frame section 1100 together.

It is further noted that the connecting mechanism for connecting the lower frame section 1200 and middle frame section 1100 may be any conventional connection mechanism that enables expanding and contracting in length to facilitate connection to various assistive ambulation devices and to accommodate individuals and equipment of various sizes.

FIG. 41 also illustrates an articulation system, which includes clamp 22 and articulation arm 3, which enables the exercise apparatus to be securely mounted to a wheelchair, walker, gait trainer, stander, and/or other assistive ambulation equipment.

Lastly, FIG. 41 illustrates curved horizontal support 63 connected between vertical sections of the lower frame section 1200 and middle frame section 1100. The fastener elements 8 are located on the curved horizontal support 63.

The curved horizontal supports (63) create a volume for the user to occupy, if needed, when using the exercise apparatus.

For example, the curved horizontal supports (63) may create a volume for the user's legs when the user is in a wheelchair.

FIG. 41 further illustrates that the upper frame section 1000 includes two vertical support sections having holes (72 and 73) at either end of each vertical support section. The vertical support sections engage the middle frame section 1100 at vertical support receiving recesses 71 of the middle frame section 1100.

As illustrated in FIG. 41, the upper frame section 1000 is connected to the middle frame section 1100 by lining up holes 72 in the upper frame section 1000 with holes in the vertical support receiving recesses 71 of the middle frame section 1100 and inserting a pin 7 through the lined up holes. This allows the overall frame to be adjusted to accommodate individuals and equipment of various sizes.

Although FIG. 41 illustrates the vertical support sections of the upper frame section 1000 being received by vertical support receiving recesses 71 of the middle frame section 1100, the middle frame section 1100 may have projecting sections and the upper frame section 1000 has a receiving portion for engaging the projecting sections.

It is noted that non-abrasive feet/skis, wheels, rollers, and/or bearings may be statically attached to the lower frame section 1200 near the fitting arms 60.

It is also noted that non-abrasive feet/skis, wheels, rollers, and/or bearings may be statically attached to a horizontal support of the lower frame section 1200, upon which the fitting arms 60 are located.

It is further noted that non-abrasive feet/skis, wheels, rollers, and/or bearings may be dynamically attached to the lower frame section 1200 near the fitting arms 60 so to allow the non-abrasive feet/skis, wheels, rollers, and/or bearings to float with the terrain and/or floor.

Lastly, it is noted that non-abrasive feet/skis, wheels, rollers, and/or bearings may be dynamically attached to a horizontal support of the lower frame section 1200, upon which the fitting arms 60 are located, so to allow the non-abrasive feet/skis, wheels, rollers, and/or bearings to float with the terrain and/or floor.

With respect to FIG. 41, the handle section 1300 includes a curved horizontal support. The curved horizontal support has located thereon a receiving recess 75 for receiving a manipulative striking apparatus attachment; such as a bat shaped manipulative striking apparatus attachment 81, a lacrosse stick shaped manipulative striking apparatus attachment 82, a paddle/racket shaped manipulative striking apparatus attachment 83, a golf club shaped manipulative striking apparatus attachment 84, etc.

The handle section 1300 is connected to the manipulative striking apparatus attachment by lining up holes in the receiving recess 75 with holes in the manipulative striking apparatus attachment and inserting a pin 7 through the lined up holes.

Although FIG. 41 illustrates the manipulative striking apparatus attachment as being projections that are received by receiving recess 75, the handle section 1300 may have a projecting section and the manipulative striking apparatus attachment has a receiving portion.

FIG. 41 illustrates that the handle section 1300 includes receiving recesses 74 for receiving the vertical supports of the upper frame section 1000. The handle section 1300 is connected to the vertical supports of the upper frame section 1000 by lining up holes in the receiving recess 74 with holes 73 in the vertical supports of the upper frame section 1000 and inserting a pin 7 through the lined up holes.

Although FIG. 41 illustrates the vertical supports of the upper frame section 1000 as being projections that are received by receiving recess 74, the handle section 1300 may have a projecting section and the vertical supports of the upper frame section 1000 have a receiving portion.

Lastly, FIG. 41 illustrates that the handle section 1300 includes a handle attachment section 76 for attaching handles thereto.

Figure 42:
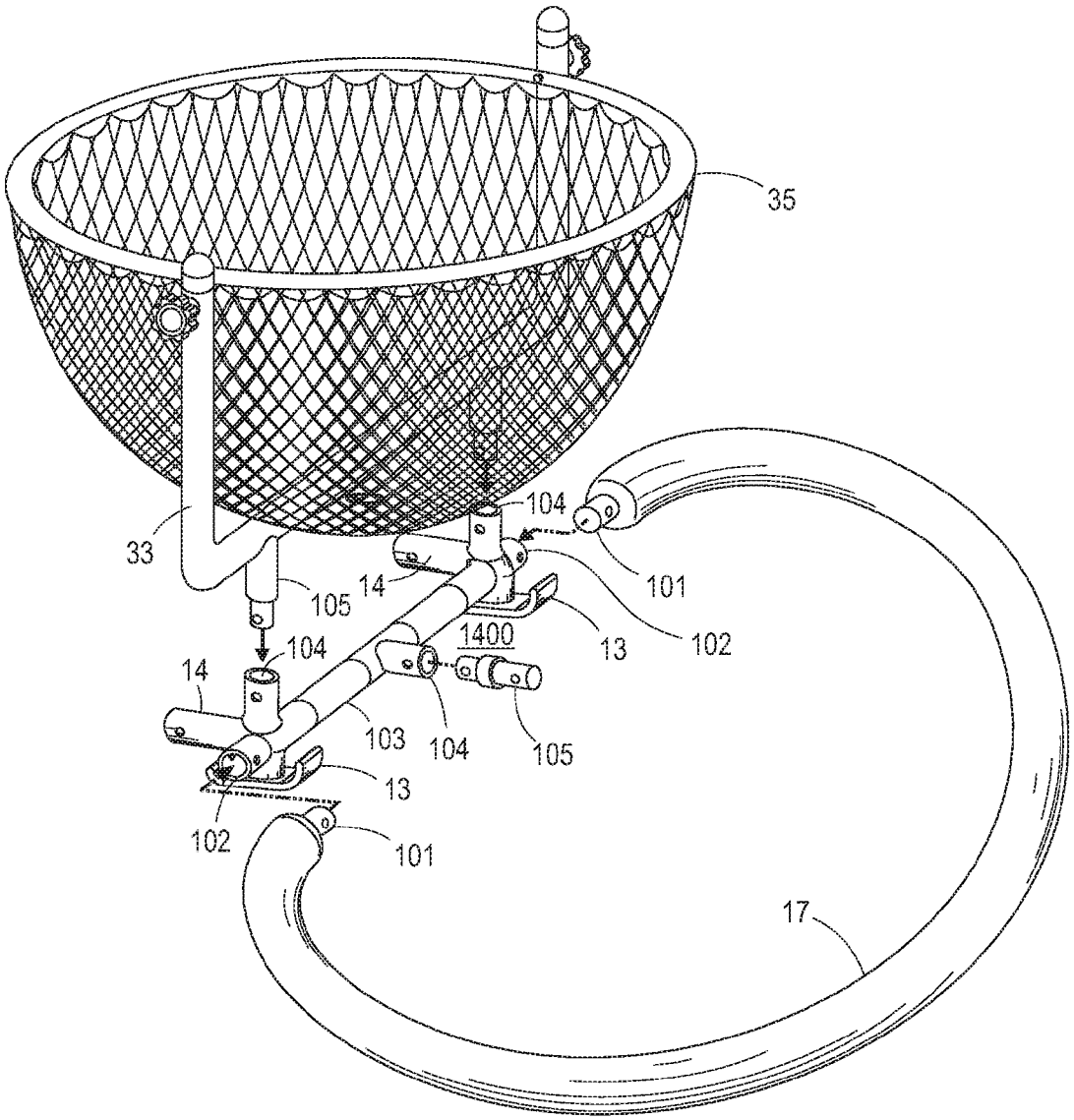
FIG. 42 illustrates a multiple accessory attachment device for attaching to the exercise apparatus to enable attachment of various accessories.

FIG. 42 illustrates an accessory attachment interface 1400. The accessory attachment interface 1400 provides a mechanical (connection) interface between a lower frame section 1200, as illustrated in FIGS. 40 and 41, and various attachments.

The accessory attachment interface 1400 includes receiving recesses 14 for receiving fitting arms of a lower frame section and a horizontal support 103. The receiving recesses 14 are orthogonal to a cross support 103 member.

It is noted that that the receiving recesses could be part of the lower frame section and the fitting arms part of the accessory attachment interface 1400.

The accessory attachment interface 1400 includes side receiving recesses 102 for receiving projections 101 of a detachable manipulative object controlling apparatus attachment 17, such as discussed above. The side receiving recesses 102 are orthogonal to receiving recesses 14 and parallel to the cross support member 103.

The accessory attachment interface 1400 further includes a forward receiving recess 104 for receiving a projection of a manipulative striking apparatus attachment (not shown), such as discussed above. The forward receiving recess 104, for receiving a projection of a manipulative striking apparatus, is orthogonal to the cross support member 103.

FIG. 42 further illustrates a conversion projection 105 which converts the forward receiving recess 104 into a projection for engaging a receiving recess of a manipulative striking apparatus attachment (not shown).

The accessory attachment interface 1400 includes upper receiving recesses 104 for receiving projections 105 of a detachable apparatus attachment, such as the illustrated hoop/basket 35 of attachment 33. The upper receiving recesses 104, for receiving projections 105 of a detachable apparatus attachment, are orthogonal to the cross support member 103 and are orthogonal to he side receiving recesses 102 and the receiving recesses 14.

The accessory attachment interface 1400 includes attached non-abrasive feet/skis 13.

It is noted that the accessory attachment interface 1400 may have wheels, rollers, and/or bearings which are mounted to the accessory attachment interface 1400, to facilitate contact with the ground or floor.

It is further noted that the non-abrasive feet/skis 13, wheels, rollers, and/or bearings may be statically attached to the accessory attachment interface 1400.

It is also noted that the non-abrasive feet/skis 13, wheels, rollers, and/or bearings may be dynamically attached to the accessory attachment interface 1400 so to allow the non-abrasive feet/skis 13, wheels, rollers, and/or bearings to float with the terrain and/or floor.

It is noted that although the various ramps discussed above were illustrated as single integral frames the ramps can be constructed of an adjustable frame, collapsible frame, foldable frame, or modular frames to facilitate easier transport and storage.

An exercise apparatus includes an adjustable frame being attachable to an assistive ambulation device. The adjustable frame includes removable handles, fitting arms located on a lower portion of the adjustable frame to receive a fitness attachment, and attachment points on located on the lower portion of the adjustable frame to couple a resistance device.

The exercise apparatus may include a transport attachment, connectable to the fitting arms, to transport an object; a paddle attachment, connectable to the fitting arms, for striking an object; a ramp attachment, connectable to an upper portion of the adjustable frame, for rolling an object; or a ring, connectable to said fitting arms, for manipulating an object.

The resistance device may be resistance tubing.

The apparatus may include a hoop/net attachment, connectable to an upper portion of the adjustable frame; a clamp and articulating arm system, the clamp and articulating arm system enabling the adjustable frame to be connected to an assistive ambulation device; a relay switch system to control electrical components associated with the adjustable frame; or a sound device.

A jump rope trainer includes a handle; flexible tubing including a handle fastener to connect the handle to the flexible tubing; and a soft sphere shaped object. The flexible tubing includes a soft sphere shaped object fastener to connect the soft sphere shaped object to the flexible tubing.

The handle may include a hook and loop textile affixed thereto.

The jump rope trainer may include an adjustable hook and loop glove for gripping the hook and loop textile of the handle.

An exercise apparatus includes a frame being attachable to an assistive ambulation device. The frame includes fitting arms located on a lower portion of said frame to receive a fitness attachment and attachment points on located on the frame to couple a resistance device.

The apparatus may include a clamp and articulating arm system. The clamp and articulating arm system connects the frame to the assistive ambulation device.

The frame may be constructed of a lower frame section and an upper frame section. The lower frame section is detachable from and attachable to the upper frame section.

The lower frame section is attachable to the upper frame section at multiple locations so as to adjust a size of the frame.

The exercise apparatus may include detachable handles attachable to the upper frame section.

The exercise apparatus may include detachable handles attachable to the frame.

The exercise apparatus may include a ring, connectable to the fitting arms, for manipulating an object.

The resistance device may be resistance tubing.

The exercise apparatus may include non-abrasive feet/skis to facilitate contact with the ground or floor.

The exercise apparatus may include an accessory attachment interface connectable to the fitting arms.

The accessory attachment interface may include receiving recesses for receiving the fitting arms, side receiving recesses for receiving projections of a detachable manipulative object controlling apparatus attachment, a forward receiving recess for receiving a projection of a manipulative striking apparatus attachment, and upper receiving recesses for receiving projections of a detachable apparatus attachment.

The accessory attachment interface may include non-abrasive feet/skis to facilitate contact with the ground or floor.

An accessory attachment interface for use with an exercise apparatus attachable to an assistive ambulation device includes a support member. The support member includes receiving recesses for receiving fitting arms of the exercise apparatus side receiving recesses for receiving projections of a detachable manipulative object controlling apparatus attachment, a forward receiving recess for receiving a projection of a manipulative striking apparatus attachment, and upper receiving recesses for receiving projections of a detachable apparatus attachment.

The support member may include non-abrasive feet/skis to facilitate contact with the ground or floor.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An exercise apparatus comprising:

an adjustable frame being configured for attaching to an assistive ambulation device;

said adjustable frame including an upper frame portion and a lower frame portion;

said upper frame portion including a first upper frame member, a second upper frame member, and an upper frame horizontal support, said upper frame horizontal support being orthogonally connected to said first upper frame member and being orthogonally connected to said second upper frame member;

said lower frame portion including, a first lower frame member having a first upper portion and a first lower portion, and a second lower frame member having a second upper portion and a second lower portion, and a lower frame horizontal support;

said lower frame horizontal support being orthogonally connected to said first lower frame member between said first upper portion and said first lower portion;

said lower frame horizontal support being orthogonally connected to said second lower frame member between said second upper portion and said second lower portion;

said first lower portion including a first fitting arm, said first fitting arm being configured for receiving a fitness attachment;

said second lower portion including a second fitting arm, said second fitting arm being configured for receiving the fitness attachment;

said first upper portion being co-linearly connected to said first upper frame member;

said second upper portion being co-linearly connected to said second upper frame member;

said first lower portion being bent;

said second lower portion being bent;

said first upper lower frame member being straight;

said second upper lower frame member being straight.

2. The apparatus as claimed in claim 1, further comprising:

a clamp and articulating arm system;

said clamp and articulating arm system being configured for connecting said adjustable frame to the assistive ambulation device.

3. The exercise apparatus as claimed in claim 1, further comprising:

detachable handles being configured for attaching to said upper frame portion.

4. The exercise apparatus as claimed in claim 1, further comprising:

a first non-abrasive feet/skis, configured for connecting to said first fitting arm, to facilitate contact with the ground or floor; and a second non-abrasive feet/skis, configured for connecting to said second fitting arm, to facilitate contact with the ground or floor.

5. The apparatus as claimed in claim 1, further comprising:

a ring, configured for connecting to said first fitting arm and said second fitting arm, for manipulating an object.

6. The apparatus as claimed in claim 1, further comprising resistance tubing configured for detachably attaching to said upper frame horizontal support.

7. The apparatus as claimed in claim 1, wherein said lower frame portion includes non-abrasive feet/skis to facilitate contact with the ground or floor.

8. The apparatus as claimed in claim 1, further comprising:

an accessory attachment interface configured for connecting to said first fitting arm and said second fitting arm.

9. The apparatus as claimed in claim 8, wherein said accessory attachment interface includes receiving recesses configured for receiving said first fitting arm and said second fitting arm, side receiving recesses configured for receiving projections of a detachable manipulative object controlling apparatus attachment, a forward receiving recess configured for receiving a projection of a manipulative striking apparatus attachment, and upper receiving recesses configured for receiving projections of a detachable apparatus attachment.

10. The apparatus as claimed in claim 9, wherein said accessory attachment interface includes non-abrasive feet/skis to facilitate contact with the ground or floor.

11. The exercise apparatus as claimed in claim 1, wherein said first upper frame member includes a first upper frame attachment section;

said second upper frame member including a second upper frame attachment section;

said first upper lower frame member including a first lower frame attachment section; and said second upper lower frame member including a second lower frame attachment section;

said first and second upper frame attachment sections and said first and second lower frame attachment sections being located between said upper frame horizontal support and said first lower frame horizontal support when said first upper frame attachment section is attached to said first upper portion and said second upper frame attachment section is attached to said second upper portion.

12. The exercise apparatus as claimed in claim 11, wherein said first and second lower frame attachment sections include multiple lower frame attachment sites and said first and second upper frame attachment sections includes multiple upper frame attachment sites.

13. The exercise apparatus as claimed in claim 12, wherein said upper frame portion is configured for selectively attaching, using said multiple lower frame attachment sites and said multiple upper frame attachment sites, to said lower frame portion to adjust a dimension of said adjustable frame.

14. An accessory attachment interface for interfacing an accessory with an exercise apparatus attached to an assistive ambulation device, comprising:

a support member;

said support member including, a first receiving recess configured for receiving a first fitting arm of the exercise apparatus, a second receiving recess configured for receiving a second fitting arm of the exercise apparatus, a cross support member orthogonal to and located between said first receiving recess and said second receiving recess, a first side receiving recess, orthogonal to said first receiving recess and parallel to said cross support member, configured for receiving a projection of the accessory, a second side receiving recess, orthogonal to said second receiving recess and parallel to said cross support member, configured for receiving a projection of the accessory, a forward receiving recess, located on said cross support member, configured for receiving a projection of the accessory, a first upper receiving recess, orthogonal to said first receiving recess and orthogonal to said cross support member, configured for receiving a projection of the accessory, and a second upper receiving recess, orthogonal to said second receiving recess and orthogonal to said cross support member, configured for receiving a projection of the accessory.

15. The accessory attachment interface as claimed in claim 14, wherein said support member includes non-abrasive feet/skis to facilitate contact with the ground or floor.

* * * * *